US006929894B2

(12) United States Patent
Sugahara et al.

(10) Patent No.: US 6,929,894 B2
(45) Date of Patent: Aug. 16, 2005

(54) TONER AND FIXING METHOD

(75) Inventors: Nobuyoshi Sugahara, Shizuoka (JP); Masaaki Taya, Ibaraki (JP); Junko Yoshikawa, Ibaraki (JP); Takayuki Itakura, Shizuoka (JP); Yojiro Hotta, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/191,549

(22) Filed: Jul. 10, 2002

(65) Prior Publication Data

US 2004/0009420 A1 Jan. 15, 2004

(51) Int. Cl.[7] ..... G03G 9/087; G03G 13/20

(52) U.S. Cl. ..... 430/108.3; 430/108.1; 430/108.4; 430/108.8; 430/109.4; 430/124

(58) Field of Search ..... 430/109.4, 108.4, 430/108.3, 108.8, 108.1, 124; 399/328, 331, 332, 333

(56) References Cited

U.S. PATENT DOCUMENTS

| | | | | |
|---|---|---|---|---|
| 4,301,355 | A | 11/1981 | Kimbrough et al. | 219/137 |
| 4,921,771 | A | 5/1990 | Tomono et al. | 430/110 |
| 4,970,219 | A | 11/1990 | Effland et al. | 514/339 |
| 5,149,941 | A | 9/1992 | Hirabayashi et al. | 219/216 |
| 5,210,579 | A | 5/1993 | Setoriyama et al. | 355/285 |
| 5,330,871 | A | 7/1994 | Tanikawa et al. | 430/110 |
| 5,525,775 | A | 6/1996 | Setoriyama et al. | 219/216 |
| 5,851,714 | A | 12/1998 | Taya et al. | 430/110 |
| 6,013,402 | A | 1/2000 | Kanbayashi et al. | 430/45 |
| 6,586,147 | B2 * | 7/2003 | Iida et al. | 430/45 |

FOREIGN PATENT DOCUMENTS

| | | | |
|---|---|---|---|
| JP | 51-109739 | 9/1976 | G06K/15/18 |
| JP | 52-003304 | 1/1977 | G03G/9/08 |
| JP | 52-003305 | 1/1977 | G03G/9/08 |
| JP | 57-052574 | 3/1982 | B23K/9/12 |
| JP | 63-313182 | 12/1988 | G03G/15/20 |
| JP | 01-185660 | 7/1989 | G03G/9/08 |
| JP | 01-185661 | 7/1989 | G03G/9/08 |
| JP | 01-185662 | 7/1989 | G03G/9/08 |
| JP | 01-185663 | 7/1989 | G03G/9/08 |
| JP | 01-238672 | 9/1989 | G03G/9/08 |
| JP | 02-157878 | 6/1990 | G03G/15/20 |
| JP | 04-044075 | 2/1992 | G03G/15/20 |
| JP | 04-107467 | 4/1992 | G03G/9/08 |
| JP | 04-149559 | 5/1992 | G03G/9/087 |
| JP | 04-204980 | 7/1992 | G03G/15/20 |
| JP | 04-301853 | 10/1992 | G03G/9/08 |
| JP | 05-061238 | 3/1993 | G03G/9/08 |
| JP | 2001-272812 | * 10/2001 | |

OTHER PUBLICATIONS

Thomson–Derwent machine–assisted translation of JP 2001–272812 A (pub. Oct. 2001).*

Japanese Patent Office Machine–Assisted English–Language Translation of JP 2001–272812, (pub. Oct. 2001).*

* cited by examiner

*Primary Examiner*—Janis L. Dote

(74) *Attorney, Agent, or Firm*—Fitzpatrick, Cella, Harper & Scinto

(57) ABSTRACT

A toner is disclosed which is composed of toner particles containing at least a binder resin, a colorant and a wax, and an external additive. The wax has, in its DSC endothermic curve, a maximum endothermic peak at 55° C. to 80° C. within the temperature range from 30° C. to 160° C., the maximum endothermic peak having a half width of from 2° C. to 7° C., and the binder resin is composed chiefly of a polyester resin. The toner has a dynamic elastic modulus from $5\times10^2$ to $1\times10^5$ dN/m$^2$ at 140° C., and its ratio to a dynamic elastic modulus at 170° C. is from 0.05 to 50, and the toner contains 10 to 20% by weight of THF-insoluble matter A of a binder resin component after 8 hours from the start of extraction and 1 to 10% by weight of THF-insoluble matter B of the binder resin component after 24 hours from the start of extraction, the ratio of A to B, B/A, being from 0.1 to 0.8. Also disclosed is a fixing method making use of this toner.

8 Claims, 8 Drawing Sheets

TONER AND FIXING METHOD

BACKGROUND OF THE INVENTION

1. Field of the Invention

This invention relates to a toner, and a fixing method improved in fixing performance, making use of a heating unit of an electromagnetic-induction heating system.

2. Related Background Art

In image-forming apparatus, assemblies of a heat roller system have widely been used as fixing assemblies by means of which unfixed images (toner images) of intended image information, formed and held on recording mediums (such as transfer material sheets, electrofascimile sheets, electrostatic recording paper, OHP sheets, printing sheets and format sheets) by a transfer system or direct system at an appropriate site for carrying out an image-forming process such as an electrophotographic process, an electrostatic recording process or a magnetic recording process are heat-fixed as permanent fixed images to the surface of the recording medium. Nowadays, from the viewpoint of quick start and energy saving, assemblies of a belt or film heating system have put into practical use. Assemblies of an electromagnetic-induction heating system are also proposed. Fixing assembles of these systems have device construction and advantages or disadvantages as described below.

a) Fixing Assembly of Heat Roller System:

This is an assembly constituted basically of paired pressure contact rollers of a fixing roller (heat roller) and a pressure roller. The paired rollers are rotated, and a recording medium on which unfixed toner images to be imagewise fixed have been formed and held is guided to, and held tight at, a fixing nip which is a zone of mutual pressure contact of the paired rollers, where the unfixed toner images are fixed by heat and pressure to the recording medium surface by the action of the heat of the fixing roller and the pressing force at the fixing nip.

The fixing roller commonly comprises as a substrate (mandrel) a hollow metal roller made of aluminum, and as a heat source a halogen lamp inserted into the former's internal space. It is heated by the heat the halogen lamp generates, and is temperature-controlled by controlling electrification to the halogen lamp so that its peripheral surface can be maintained at a preset fixing temperature.

In particular, in a fixing assembly of an image-forming apparatus for forming full-color images, which is required to have the ability to sufficiently heat and melt toner image layers which are four layers at the maximum, a material having a high heat capacity is used as the mandrel of the fixing roller and a rubber elastic layer for enveloping the toner images to melt them uniformly is provided on the periphery of the mandrel. The toner images are heated through the rubber elastic layer. In some construction, a heat source is also provided in the interior of the pressure roller so that the pressure roller may also be heated and temperature-controlled.

In the fixing assembly of such a heat roller system, however, even when the power source of the image-forming apparatus is switched on and at the same time the halogen lamp, the heat source of the fixing assembly, is started to be electrified, the fixing roller requires so large a heat capacity that a considerable wait time is taken until the temperature of the assembly rises to a preset fixable temperature from the time the fixing roller stands cold entirely. Thus, this fixing assembly lacks in quick-start performance. Also, it is necessary to electrify the halogen lamp to maintain the fixing roller to a prescribed temperature-controlled state so that the action of image formation can be taken at any time also when the image-forming apparatus is kept stand-by (during non-image-formation). Thus, there has been a problem such that it requires a large power consumption.

In addition, in a fixing assembly making use of a fixing roller requiring an especially large heat capacity as in the case of the fixing assembly of the full-color image-forming apparatus, a delay may occur between temperature control and fixing roller surface temperature rise to cause problems such as faulty fixing, non-uniform gloss and offset.

b) Fixing Assembly of Film Heating System:

The fixing assembly of a film heating system is disclosed in, e.g., Japanese Patent Applications Laid-open No. 63-313182, No. 2-157878, No. 4-44075 and No. 4-204980.

More specifically, a heat-resistant film (fixing film) is held commonly between a ceramic heater as a heating element and a pressure roller as a pressure member to form a nip between them. A recording medium on which unfixed toner images to be imagewise fixed have been formed and held is guided to the zone between the film and the pressure roller at the nip, and held tight and transported together with the film so that the heat of the ceramic heater is imparted to the recording medium at the nip via the film and the unfixed toner images are fixed by heat and pressure to the recording medium surface by the aid of the pressing force at the nip.

The fixing assembly of such a film heating system can be constructed as an on-demand type assembly by using low-heat-capacity members as the ceramic heater and the film. The ceramic heater as a heat source may be electrified only when the image-forming apparatus performs image formation, to bring it into a condition where the heat has been generated at a stated fixing temperature. Thus, this fixing assembly has such an advantage that the wait time from switching on the power source of the image-forming apparatus up to a state the image formation can be performed is short (quick-start performance) and the power consumption at the standby time is greatly small (power saving).

However, as a fixing assembly for full-color image-forming apparatus and high-speed type machines, there is a difficulty in respect of the quantity of heat.

c) Fixing Assembly of Electromagnetic-induction Heating System:

Japanese Utility Model Application Laid-open No. 51-109739 discloses an induction heating fixing assembly in which electric current is induced to a fixing roller by a magnetic field to generate heat by the Joule effect. This can make the fixing roller generate heat directly by utilizing the generation of induced current, and accomplishes a fixing process which is more highly efficient than the fixing assembly of a heat roller system employing the halogen lamp as a heat source.

However, this assembly involves a great heat loss by heat dissipation because the energy of alternating magnetic field that has been induced by exciting coils serving as a magnetic-field induction means is used to heat the whole fixing roller, and has such a disadvantage that the density of fixing energy with respect to the applied energy is so low as to bring about a poor efficiency.

Accordingly, in order to obtain at a high density the energy acting on fixing, the exciting coil are set close to the fixing roller which is a heating element, or the alternating magnetic field distribution attributable to the exciting coils is concentrated in the vicinity of the fixing nip. Thus, a high-efficiency fixing assembly has been contrived.

Meanwhile, with regard to toners, e.g., black toners for commonly available black and white copying machines, a relatively highly crystallizable wax as typified by polyethylene wax or polypropylene wax is used as a release agent in order to improve properties resistant to high-temperature offset at the time of fixing. For example, such toners are disclosed in Japanese Patent Publications No. 52-3304 and No. 52-3305 and Japanese Patent Application Laid-open No. 57-52574. However, in the case of toners for full-color images, their transparency may be impaired where the full-color images are projected by an OHP (overhead projector). This is due to a high crystallizability of the release agent itself and a difference in refractive index between the release agent and materials of an OHP sheet. As a result, the projected images come to have low chroma and brightness.

To solve such a problem, as disclosed in Japanese Patent Applications Laid-open No. 4-149559 and No. 4-107467, a method is proposed in which a nucleating agent is used in combination with a wax to lower the crystallizability of the wax.

A method is further proposed in which a wax having a low crystallizability is used, as disclosed in Japanese Patent Applications Laid-open No. 4-301853 and No. 5-61238. As waxes having a relatively good transparency and a low melting point, montan waxes are available. Use of such montan waxes is disclosed in Japanese Patent Applications Laid-open No. 1-185660, No. 1-185661, No. 1-185662, No. 1-185663 and No. 1-238672.

These waxes, however, are not those which sufficiently satisfy all the transparency in OHP and the low-temperature fixing performance and high-temperature anti-offset properties at the time of heat-and-pressure fixing. Accordingly, in usual color toners, the release agent is not added so far as possible and instead an oil such as silicone oil or fluorine oil is applied to the heat fixing roller so that the high-temperature anti-offset properties can be improved and the transparency in OHP can be achieved.

However, as to the fixed images thus obtained, excess oil stays attached to their surfaces. Such oil may adhere to the photosensitive member to cause contamination or the oil may swell the fixing roller to shorten the lifetime of the fixing roller.

In addition, in order not to cause any oil streaks on the fixed images, the oil must be fed to the fixing roller surface uniformly and at a constant rate. This tends to make the fixing assembly have a large size.

Accordingly, in a heat-and-pressure fixing means in which any oil for preventing high-temperature offset is not used or such oil is used in a small quantity, it is long-awaited to provide a toner having been kept from occurrence of offset and also having good secondary-color color mixing performance, having a broad color reproduction range and promising a superior transparency of fixed images.

SUMMARY OF THE INVENTION

An object of the present invention is to provide a fixing method and a toner which have solved the problems the related background art has had.

More specifically, an object of the present invention is to provide a fixing method by which a heat-receiving medium heating portion can be brought into a rise to a preset temperature in a short time (quick-start performance), the fixing performance for color toner images can well be ensured, and uniform gloss can be achieved which has been kept from any non-uniformity on the heat-receiving medium at its leading end and rear end and also in many-sheet printing.

Another object of the present invention is to provide a toner and a fixing method which enable the fixing to be performed without application of oil in a large quantity or without application of any oil at all.

Still another object of the present invention is to provide a toner and a fixing method which promise a superior low-temperature fixing performance and also superior high-temperature anti-offset properties.

A further object of the present invention is to provide a toner and a fixing method which ensure superior anti-blocking even when left standing in high-temperature environment.

A further object of the present invention is to provide a toner and a fixing method which enable multi-color toners to be well mixed to provide images having a good color reproducibility and having a superior transparency in respect of images on films for overhead projectors (OHP).

More specifically, the present invention provides a toner comprising toner particles containing at least a binder resin, a colorant and a wax, and an external additive;

the wax having, in its DSC endothermic curve, a maximum endothermic peak at 55° C. to 80° C. within a range of temperature of from 30° C. to 160° C.; the maximum endothermic peak having a half width of from 2° C. to 7° C.; and the binder resin being composed chiefly of a polyester resin;

the toner having:

a dynamic elastic modulus at a temperature of 140° C., $G'_{140}$, of from $5\times10^2$ dN/m$^2$ to $1\times10^5$ dN/m$^2$, and its ratio to a dynamic elastic modulus at a temperature of 170° C., $G'_{170}$, i.e., $G'_{140}/G'_{170}$ being from 0.05 to 50; and in Soxhlet extraction of the toner by using tetrahydrofuran (THF) as a solvent, THF-insoluble matter A of a binder resin component after 8 hours from the start of extraction being from 10% by weight to 20% by weight and THF-insoluble matter B of the binder resin component after 24 hours from the start of extraction being from 1% by weight to 10% by weight; a ratio of the THF-insoluble matter A to the THF-insoluble matter B, B/A, being from 0.1 to 0.8.

The present invention also provides a fixing method in which, using (1) a magnetic-field induction means, (2) a rotary heating member having at least a heating layer which generates heat by electromagnetic induction and a release layer and (3) a heating and pressing means having at least a rotary pressure member which forms a nip together with the rotary heating member, the rotary pressure member is pressed against the rotary heating member via a recording medium, during which a toner image held on the recording medium is fixed by heat and pressure to form a fixed image on the recording medium;

the method making use of the toner constructed as described above.

DETAILED DESCRIPTION OF PREFERRED EMBODIMENTS

The toner according to the present invention is described first.

The toner of the present invention basically comprises toner particles containing at least a binder resin, a colorant and a wax, and an external additive.

In the present invention, the binder resin of the toner particles is a resin composed chiefly of a polyester resin, which is preferably a polyester resin having a carboxyl group and having a molecular skeleton represented by the following Formula (1).

Formula (1):

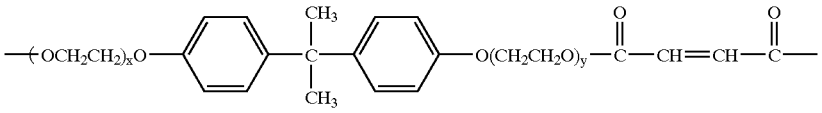

wherein x and y are each an integer of 1 or more, and an average value of x+y is 2 to 4.

The polyester resin having the molecular skeleton represented by Formula (1) may readily form a metal ion cross-linked structure when it is melt-kneaded simultaneously with a salicylic acid metal compound detailed later, and such a resin can suitably be used for producing a toner having a clear minimum value (G'min) in the toner's dynamic elastic modulus curve.

Figure 1:
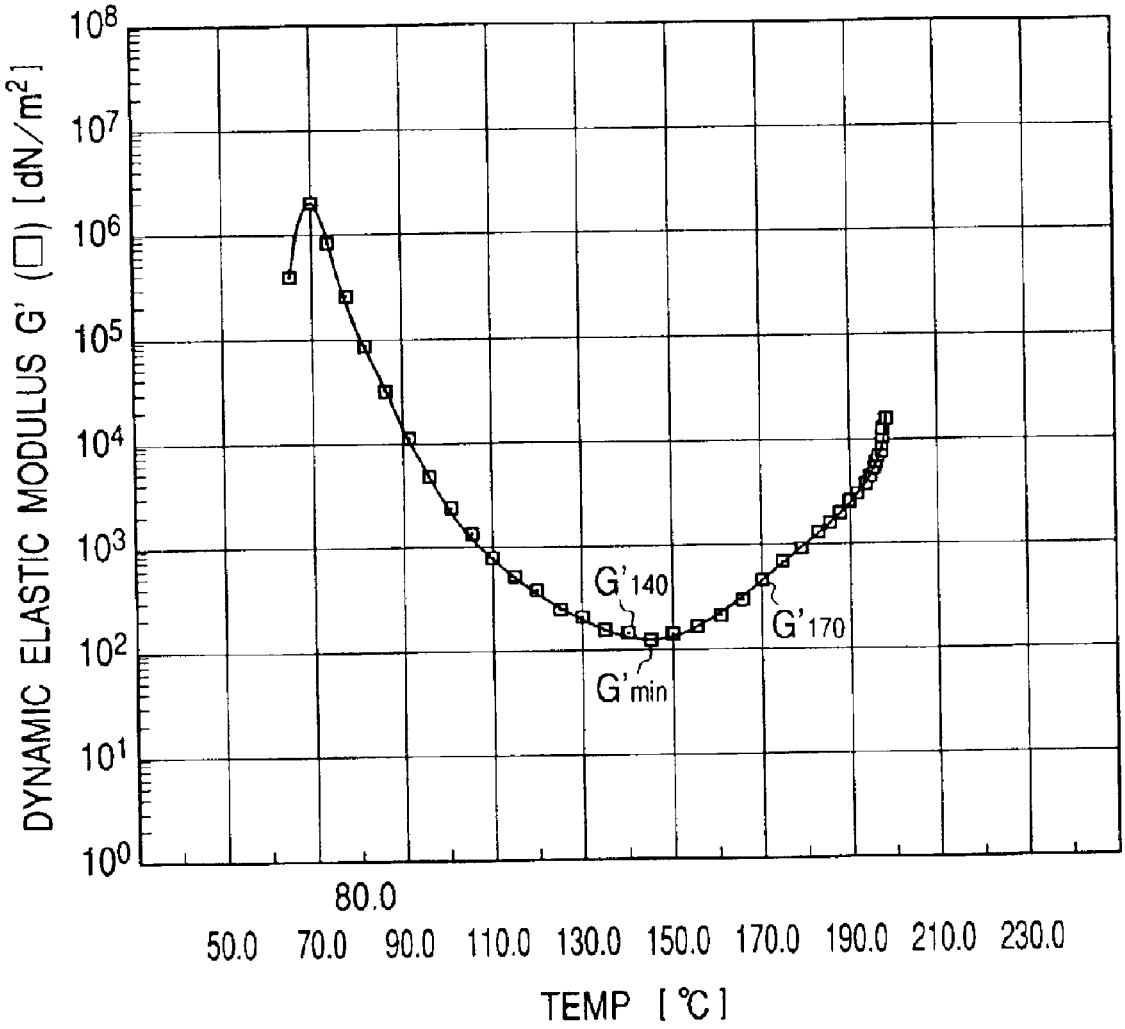
FIG. 1 is a graph showing an example of a dynamic elastic modulus curve of the toner according to the present invention.
Figure 2:
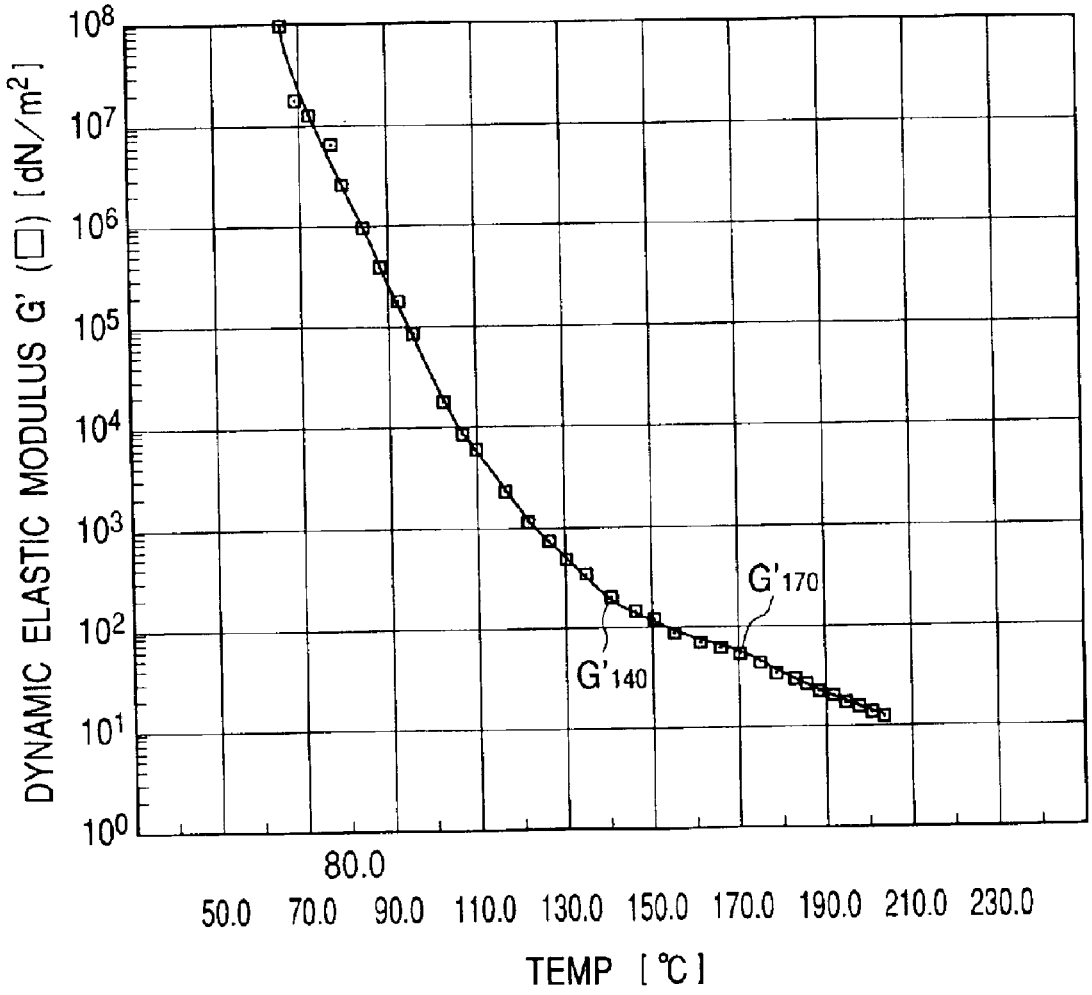
FIG. 2 is a graph showing an example of a dynamic elastic modulus curve of a conventional toner.

For example, in the dynamic elastic modulus curve shown in FIG. 1, which is for a toner similar to that of Examples given later, the dynamic elastic modulus in the region of a temperature of 170° C., $G'_{170}$, is on the higher temperature side relative to the dynamic elastic modulus in the region of a temperature of 140° C., $G'_{140}$, at which temperature the toner has a high viscoelasticity. Hence, the toner has very good high-temperature anti-offset properties.

The present inventors have discovered that the ratio of the dynamic elastic modulus at a temperature of 140° C., $G'_{140}$ to the dynamic elastic modulus at a temperature of 170° C., $G'_{170}$, i.e., $G'_{140}/G'_{170}$ has a strong correlation with the high-temperature anti-offset properties, and a toner the ratio $G'_{140}/G'_{170}$ of which is within the range of from 0.05 to 50 has good transparency in OHP and also has good secondary-color color mixing properties, and hence a toner and a fixing method which promise a broad color reproduction range can be provided and also a toner and a fixing method which promise superior low-temperature fixing performance and also superior high-temperature anti-offset properties can be provided.

If the value of $G'_{140}/G'_{170}$ is less than 0.05, the toner may have insufficient transparency in OHP, and also may have insufficient secondary-color color mixing properties to tend to have a narrow color reproduction range.

If on the other hand the value of $G'_{140}/G'_{170}$ is more than 50, the dynamic elastic modulus of the toner is extremely lowered with the rise of temperature even on the higher temperature side relative to the temperature of 140° C. Such a toner has poor high-temperature anti-offset properties, and has a narrower fixable temperature range than the toner of the present invention.

The reason why the molecular skeleton represented by Formula (1) reacts specifically with a salicylic acid metal compound has not well been elucidated. It is presumed that flexing properties peculiar to this molecular chains may readily form a conformation which easily causes interaction (molecular arrangement mutual interaction), and that the electron-donating properties of the phenyl group having electron-donating properties at the p-position and the π-electron-donating properties of —CH═CH— are deeply concerned.

The metal ion cross-linked structure concerning the toner of the present invention appears as a change ascribable to extraction time in the Soxhlet extraction with tetrahydrofuran(THF)-insoluble matter.

It is important that a soft cross-linked structure such that the cross-linked structure comes loose because of the salvation energy of THF is formed, which is characterized in that THF-insoluble matter A of the binder resin component after 8 hours from the start of extraction is in a content of from 10% by weight to 20% by weight and THF-insoluble matter B of the binder resin component after 24 hours from the start of extraction is in a content of from 1% by weight to 10% by weight and that the ratio of the THF-insoluble matter A to the THF-insoluble matter B, B/A, is from 0.1 to 0.8. The present inventors has discovered that the correlation between the THF-insoluble matter B of the binder resin component after 24 hours from the start of extraction and the THF-insoluble matter A of the binder resin component after 8 hours from the start of extraction is concerned with the fixing performance.

As long as the ratio of the THF-insoluble matter A to the THF-insoluble matter B, B/A, is within the range of from 0.1 to 0.8, the high-temperature anti-offset properties, the glossiness of fixed-image surface and the low-temperature fixing performance can be satisfied. If the value of B/A is less than 0.1, the cross-linked structure may be too weak to attain sufficient high-temperature anti-offset properties. If it is more than 0.8, the fixed-image surface may have a low gloss and a poor transparency in OHP tends to result because of a strong and hard cross-linked structure.

As a dihydric alcohol component for forming the polyester resin, the chief component of the binder resin of the present invention, it may include, e.g., ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (2);

Formula (2):

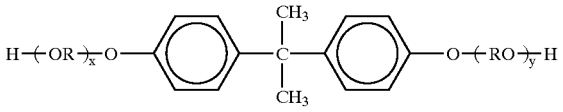

wherein R represents an ethylene group or a propylene group, x and y are each an integer of 1 or more, and an average value of x+y is 0 to 10.

A trihydric or higher alcohol component for forming a non-linear polyester resin, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene. The trihydric or higher polyhydric alcohol component may preferably be used in an amount of from 0.1 mol % to 20 mol % based on the total monomer.

As a dibasic acid component for forming the polyester resin, it may include, e.g., fumaric acid, maleic acid, maleic anhydride, succinic acid, adipic acid, sebacic acid, malonic acid, and aliphatic acid component monomers obtained by substituting any of these with a saturated or unsaturated hydrocarbon group having 8 to 22 carbon atoms; and, as aromatic acid component monomers, phthalic acid, isophthalic acid, phthalic anhydride, terephthalic acid, and ester derivatives of these.

As a tribasic or higher, polycarboxylic acid component for forming a non-linear polyester resin, it may include, e.g., 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these. The tribasic or higher, polycarboxylic acid component may preferably be used in an amount of from 0.1 mol % to 20 mol % based on the total monomer.

In the present invention, the polyester resin may preferably have a glass transition temperature of from 52° C. to 69° C., and more preferably from 54° C. to 67° C. Also, when made into a toner, the toner may have a glass transition temperature of from 55° C. to 72° C., and preferably from 57° C. to 70° C.

If the polyester resin has a glass transition temperature lower than 52° C. or the toner has a glass transition temperature lower than 55° C., the toner may have a superior fixing performance, but may undesirably have low anti-offset properties and cause contamination of the fixing roller or the winding of recording medium around the fixing roller. Moreover, the fixed image surface may undesirably have too high gloss, resulting in a low image quality level.

If the polyester resin has a glass transition temperature higher than 69° C. or the toner has a glass transition temperature higher than 72° C., the toner may have poor fixing performance to make it inevitable to raise the preset fixing temperature of the copying machine main body, and the images obtained may commonly have a low gloss. Also, as a toner for full-color printing, it may have low color-mixing properties.

In the present invention, the polyester resin may have, in GPC (gel permeation chromatography) measurement of its THF-soluble matter, a number-average molecular weight (Mn) of from 1,300 to 9,500 and a weight-average molecular weight (Mw) of from 2,600 to 190,000. In the THF-soluble matter of the polyester resin, the ratio of the weight-average molecular weight (Mw) to the number-average molecular weight (Mn), Mw/Mn, may preferably be from 2 to 20.

When made into a toner, the toner may have, in GPC measurement of its THF-soluble matter, a number-average molecular weight (Mn) of from 1,500 to 10,000 and a weight-average molecular weight (Mw) of from 3,000 to 200,000. The ratio of Mw to Mn, Mw/Mn, may preferably be from 2 to 20.

If the polyester resin has a number-average molecular weight (Mn) of less than 1,300 or a weight-average molecular weight (Mw) of less than 2,600 or if the toner has a number-average molecular weight (Mn) of less than 1,500 or a weight-average molecular weight (Mw) of less than 3,000, in either case the fixed-image surface has a high smoothness and may look clear, but high-temperature offset tends to occur during running (or in extensive operation). Also, the toner may have low long-term storage stability, and is supposed to cause an additional problem such that the toner may melt-adhere to the interior of developing machine and the toner may stick to the carrier surface to cause carrier-spent. In addition, shear may be applied with difficulty at the time of melt kneading of toner materials when color toner particles are produced, tending to result in low dispersion of the colorant, so that deterioration in the coloring power of the toner and variations in the charge quantity of the toner are liable to occur.

If the polyester resin has a number-average molecular weight (Mn) of more than 9,500 or a weight-average molecular weight (Mw) of more than 190,000 or if the toner has a number-average molecular weight (Mn) of more than 10,000 or a weight-average molecular weight (Mw) of more than 200,000, in either case the toner may have superior anti-offset properties, but the fixing temperature is obliged to be set higher. Also, even if the extent of dispersion of a pigment has been controllable, image areas may have a low surface smoothness and the toner may have low color reproducibility.

If the polyester resin or the toner has Mw/Mn of less than 2, the resultant polyester resin may commonly have a small value in its molecular weight. Hence, like the above case where it has a small molecular weight, the phenomenon of high-temperature offset tends to occur during running, the toner may have low long-term storage stability, the toner tends to melt-adhere to the interior of developing machine and cause carrier-spent, and also the toner tends to have non-uniform charge quantity.

If the polyester resin or the toner has Mw/Mn of more than 20, the toner may have superior anti-offset properties, but the fixing temperature is obliged to be set higher. Also, even if the extent of dispersion of a pigment has been controllable, image areas may have a low surface smoothness and the toner may have low color reproducibility.

In particular, it is preferable for the polyester resin to have been made non-linear by the tribasic or higher, polycarboxylic acid component or the trihydric or higher, polyhydric alcohol component. The polyester resin having a non-linear structure may be obtained by, e.g., a method in which in the first stage the dibasic carboxylic acid component or dibasic carboxylic ester component and the dihydric alcohol component are subjected to condensation polymerization to produce a linear prepolymer, and in the second stage the linear prepolymer and the dibasic carboxylic acid component (or an ester thereof), as well as the dihydric alcohol component and the trihydric or higher, polyhydric alcohol component (or an ester or acid anhydride thereof) or the trihydric or higher, polyhydric alcohol component are subjected to condensation polymerization.

As a metal which forms the salicylic acid metal compound usable in the toner according to the present invention may preferably be a divalent or higher metal atom. As a divalent metal, it may include $Mg^{2+}$, $Ca^{2+}$, $Sr^{2+}$, $Pb^{2+}$, $Fe^{2+}$, $Co^{2+}$, $Ni^{2+}$, $Zn^{2+}$, $Cu^{2+}$. Of these divalent metals, $Zn^{2+}$, $Ca^{2+}$, $Mg^{2+}$ and $Sr^{2+}$ are preferred. As a trivalent or higher metal, it may include $Al^{3+}$, $Cr^{3+}$, $Fe^{3+}$ and Ni4+. Of these metals, $Al^{3+}$ and $Cr^{3+}$ are preferred, and $Al^{3+}$ is particularly preferred.

In the present invention, as the salicylic acid metal compound, an aluminum compound of di-tert-butylsalicylic acid is particularly preferred.

The salicylic acid metal compound may be synthesized by, e.g., dissolving salicylic acid in an aqueous sodium hydroxide solution, adding dropwise to the aqueous sodium hydroxide solution an aqueous solution in which a divalent or higher metal atom has been dissolved, heating and stirring the solution, then adjusting its pH, and cooling the solution to room temperature, followed by filtration and water washing to produce a metal compound of the salicylic acid. It should be noted that the method is by no means limited only to such a synthesis method.

The salicylic acid metal compound may preferably be used in an amount of from 0.1 to 10% by weight, and more preferably from 0.5 to 9% by weight, based on the weight of the toner, because the charge quantity of toner may less undergo initial-stage variation, the absolute charge quantity necessary at the time of development may readily be attained, and consequently any lowering of image quality such as "fog" and decrease in image density does not occur.

As the colorant, a pigment and/or a dye may be used. For example, the dye may include C.I. Direct Red 1, C.I. Direct Red 4, C.I. Acid Red 1, C.I. Basic Red 1, C.I. Mordant Red 1, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6.

As the pigment, it may include mineral fast yellow, navel yellow, Naphthol Yellow S, Hanza Yellow G, Permanent Yellow NCG, Tartrazine Yellow Lake, molybdenum orange, Permanent Orange GTR, Pyrazolone Orange, Benzidine Orange G, cadmium red, Permanent Red 4R, Watching Red calcium salt, Eosine Lake, Brilliant Carmine 3B, manganese violet, Fast Violet B, Methyl Violet Lake, cobalt blue, Alkali Blue Lake, Victoria Blue Lake, Phthalocyanine Blue, Fast Sky Blue, Indanthrene Blue BC, Pigment Green B, Malachite Green Lake and Final Yellow Green G.

When the toner is used as full-color toners, color pigments for a magenta toner may include, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Vat Red 1, 2, 10, 13, 15, 23, 29, 35.

Any of the above pigments may be used alone, or dyes may be used in combination with such pigments so that color sharpness can be improved. This is preferable in view of the image quality of full-color images. Magenta dyes usable in such a case may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Cyan color pigments may include C.I. Pigment Blue 2, 3, 15, 16, 17, C.I. Vat Blue 6, C.I. Acid Blue 45, or copper phthalocyanine pigments whose phthalocyanine skeleton has been substituted with 1 to 5 phthalimide methyl group(s).

Yellow color pigments may include C.I. Pigment Yellow 1, 2, 3, 4, 5, 6, 7, 10, 11, 12, 13, 14, 15, 16, 17, 23, 65, 73, 83, and C.I. vat Yellow 1, 3, 20.

The colorant may be used in an amount of from 1 part by weight to 15 parts by weight, preferably from 3 parts by weight to 12 parts by weight, and more preferably from 4 parts by weight to 10 parts by weight, based on 100 parts by weight of the binder resin.

If the colorant is in a content more than 15 parts by weight, the transparency may lower, and in addition the reproducibility of halftone as typified by human's flesh color tends to lower. Moreover, the stability of chargeability of the toner may lower to make it difficult to attain the intended charge quantity. If the colorant is in a content less than 1 part by weight, the intended coloring power may be attained with difficulty and high-quality images with high image density may be obtained with difficulty.

Where the toner of the present invention is used as a magnetic toner, the magnetic toner contains a magnetic material. The magnetic material also has the function as a colorant. The magnetic material may include iron oxides such as magnetite, hematite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of the above magnetic materials may be used alone or in a combination of two or more kinds. A particularly preferred magnetic material is fine powder of triiron tetraoxide or $\gamma$-iron sesquioxide.

These magnetic materials may preferably be those having an average particle diameter of from 0.1 $\mu$m to 2 $\mu$m (more preferably from 0.1 $\mu$m to 0.5 $\mu$m), and a coercive force of from 1.6 kA/m to 11.9 kA/m (20 to 150 oersteds), a saturation magnetization of from 50 $Am^2/kg$ to 200 $Am^2/kg$ (preferably from 50 $Am^2/kg$ to 100 $Am^2/kg$) and a residual magnetization of from 2 $Am^2/kg$ to 20 $Am^2/kg$, as magnetic properties under application of a magnetic field of 796 kA/m (10 kilo-oersteds).

The magnetic material may be used in an amount of from 10 parts by weight to 200 parts by weight, and preferably from 20 parts by weight to 150 parts by weight, based on 100 parts by weight of the binder resin.

In the present invention, as the wax, at least one kind of release agent is incorporated in the toner particles.

The release agent may include the following waxes. It may include aliphatic hydrocarbon waxes such as low-molecular weight polyethylene, low-molecular weight polypropylene, microcrystalline wax and paraffin wax; oxides of aliphatic hydrocarbon waxes such as polyethylene wax oxide, and block copolymers of these; waxes composed chiefly of a fatty ester, such as carnauba wax, sazol wax and montanic acid ester wax; and those obtained by subjecting part or the whole of a fatty ester to deoxydation treatment, such as deoxidized carnauba wax. It may also include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol, melissyl alcohol and also long-chain alkyl alcohols having a long-chain alkyl group; polyhydric alcohols such as sorbitol; fatty amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty amides such as ethylenebis(oleic acid amide), hexamethylenebis(oleic acid amide), N,N'-dioleyladipic acid amide and N,N'-dioleylsebacic acid amide; aromatic bisamides such as m-xylenebis(stearic acid amide) and N,N'-distearylisophthalic acid amide; fatty metal salts (what is commonly called metal soap) such as calcium stearate, calcium laurate, zinc stearate and magnesium stearate; grafted waxes obtained by graft-polymerizing vinyl monomers such as styrene or acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

Waxes which may particularly preferably be used may include aliphatic hydrocarbon waxes such as paraffin wax, waxes composed chiefly of aliphatic esters such as ester wax, and saturated fatty bisamides.

Waxes which may particularly preferably be used may include aliphatic hydrocarbon waxes such as paraffin wax, waxes composed chiefly of aliphatic esters such as ester wax, and saturated fatty bisamides.

The wax may preferably be used in an amount of from 0.1 part by weight to 10 parts by weight, and more preferably from 0.5 part by weight to 8 parts by weight, based on 100 parts by weight of the binder resin.

If the wax is in an amount of less than 0.1 part by weight, any release effect may not be obtained especially when the fixing oil is applied in a small quantity or when it is not used at all. If the wax is in an amount of more than 10 parts by weight, the pigment may poorly be dispersed, resulting in damage of the chroma of color toner images.

In the present invention, the wax has, in its DSC (differential scanning calorimetry) endothermic curve, a maximum endothermic peak at 55° C. to 80° C. within the range of temperature of from 30° C. to 160° C.

If a wax having the maximum endothermic peak at a temperature below 55° C. is used, since the temperature is lower than the glass transition temperature of the resin used in the present invention, the wax melts out to the toner particle surfaces when the toner is left in high-temperature environment, and hence the toner may come to have greatly poor anti-blocking properties.

If on the other hand the wax has the maximum endothermic peak at a temperature above 80° C., the wax can not quickly move to the surface of molten toner when the toner is melted to be fixed, and a poor releasability may result, tending to cause high-temperature offset.

In the wax used in the present invention, the maximum endothermic peak has a half width of from 2° C. to 7° C.

Any wax whose maximum endothermic peak has a half width above 7° C. can not quickly move to the surface of molten toner when the toner is melted to be fixed. Especially in the resin having the structure cross-linked with the metal compound, the wax may move at a low speed, and hence release effect and high-temperature anti-offset properties can not be satisfied. Also, this does not result in the formation of the soft, metal ion cross-linked structure described above.

The wax may preferably be used in an amount of from 0.1 part by weight to 10 parts by weight, and more preferably from 0.5 part by weight to 8 parts by weight, based on 100 parts by weight of the binder resin, as stated above. If the wax is more than 10 parts by weight, it may impair the dispersibility of the colorant in the toner, and no sufficient color reproducibility may be achievable. If on the other hand it is less than 0.1 part by weight, it may be insufficient to prevent the high-temperature offset that can not visually be judged.

The wax is incorporated into the binder resin usually by a method in which a resin is dissolved in a solvent and, raising the temperature of the resin solution, the wax is added and mixed therein with stirring, a method in which the wax is previously internally added when the resin is synthesized, or a method in which they are mixed at the time of kneading.

A fluidity improver may be added to the toner particles as the external additive. This is preferable in order to improve image quality. The fluidity improver is an agent which can improve the fluidity of the toner by external addition to toner particles, as seen in comparison before and after its addition.

For example, it may include fluorine resin powders such as fine vinylidene fluoride powder and fine polytetrafluoroethylene powder; fine silica powders such as wet-process silica and dry-process silica, and treated fine silica powder obtained by subjecting these fine silica powders to surface treatment with a treating agent such as a silane coupling agent, a titanium coupling agent or a silicone oil; and fine titanium oxide powder; as well as fine aluminum oxide powder, treated fine titanium oxide powder, and treated fine aluminum oxide powder.

As the fluidity improver, those having a specific surface area of 30 $m^2/g$ or more, and preferably 50 $m^2/g$ or more, as measured by the BET method utilizing nitrogen absorption provides good results. The fluidity improver may preferably be used in an amount of from 0.01 part by weight to 8 parts by weight, and preferably from 0.1 part by weight to 4 parts by weight, based on 100 parts by weight of the toner particles.

To produce the toner particles, the binder resin, the colorant, the salicylic acid metal compound, and other additives of optional components are thoroughly mixed by means of a mixing machine such as a Henschel mixer or a ball mill, and then the mixture is melt-kneaded by means of a heat kneading machine such as a kneader or an extruder, and the melt-kneaded product obtained is cooled to be solidified, thereafter the solidified product is pulverized, and the pulverized product is classified to obtain toner particles having a stated average particle diameter.

The fluidity improver and the toner particles may further sufficiently be blended by means of a mixer such as a Henschel mixer to produce a toner comprising toner particles having the fluidity improver on their surfaces.

In the present invention, the toner may have a weight-average particle diameter (D4) of from 3.0 $\mu$m to 15.0 $\mu$m, and preferably from 4.0 $\mu$m to 12.0 $\mu$m.

If the toner has a weight-average particle diameter (D4) smaller than 3.0 $\mu$m, the charge can be made stable with difficulty to tend to cause fog and toner scatter during running.

If the toner has a weight-average particle diameter (D4) larger than 15.0 μm, the toner may have greatly low image reproducibility at halftone areas, and, as the resultant images, coarse images may be formed.

The toner of the present invention may also have a volume-average particle diameter (Dv) of from 2.5 μm to 6.0 μm. This is preferable in order to form images with higher image quality.

If the toner has a volume-average particle diameter (Dv) smaller than 2.5 μm, the toner may have low charging stability. If it has a volume-average particle diameter (Dv) larger than 6.0 μm, coarse images tend to be formed.

An image-forming apparatus preferred in the present invention is described below.

Figure 3:
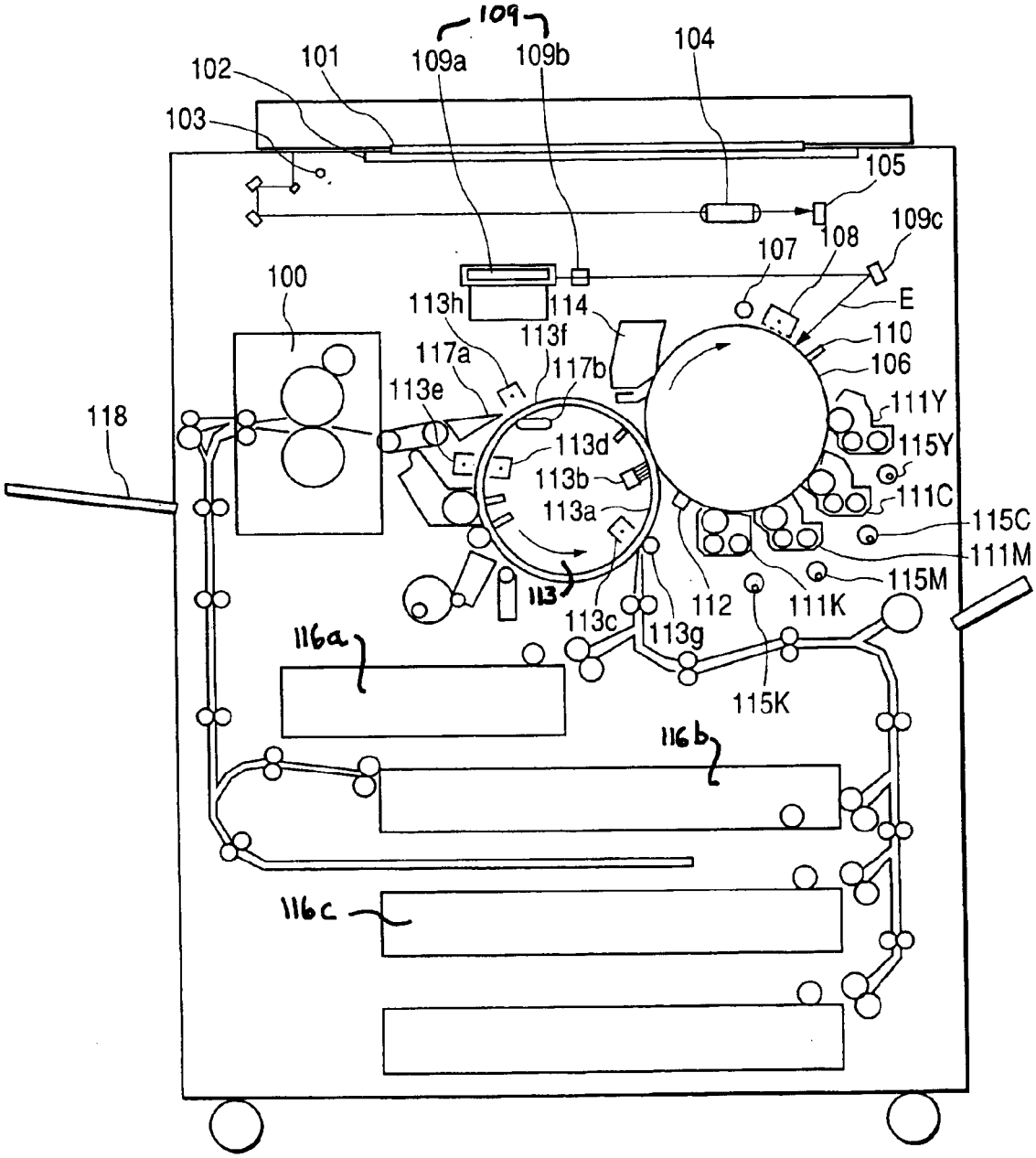
FIG. 3 is a schematic sectional view showing an example of an image-forming apparatus making use of the toner of the present invention.

(1) Example of Image-forming Apparatus:

FIG. 3 schematically illustrates the constitution of an example of an image forming apparatus for forming full-color images by electrophotography. The image forming apparatus shown in FIG. 3 is used as a full-color copying machine or a full-color printer. In the case of the full-color copying machine, it has, as shown in FIG. 3, a digital color-image reader section at the top and a digital color-image printer section at a lower part.

In the image reader section, an original 101 is placed on an original-setting glass 102, and an exposure lamp 103 is put into exposure scanning, whereby an optical image reflected from the original 101 is focused on a full-color sensor 105 through a lens 104 to obtain color separation image signals. The color separation image signals are processed by a video processing unit (not shown) through an amplifying circuit (not shown), and then forwarded to the digital color-image printer section.

In the image printer section, a photosensitive drum 106 as an image bearing member has a photosensitive layer having, e.g., an organic photoconductor, and is supported to freely rotate in the direction of an arrow. Around the photosensitive drum 106, a pre-exposure lamp 107, a corona charging assembly 108, a laser exposure optical system 109, a potential sensor 110, four different color developing assemblies 111Y, 111C, 111M and 111K, a detecting means 112 for detecting the amount of light on the drum, a transfer unit 113 and a cleaner 114 are provided.

In the laser exposure optical system, the image signals sent from the reader section are, at a laser output section (not shown), converted into optical signals for image scanning exposure, and the laser light thus converted is reflected on a polygonal mirror 109*a* and projected on the surface of the photosensitive drum 106 through a lens 109*b* and a mirror 109*c*.

In the printer section, the photosensitive drum 106 is rotated in the direction of the arrow at the time of image formation. The photosensitive drum 106 is, after decharged by the pre-exposure lamp 107, uniformly negatively charged by means of the charging assembly 108, and then irradiated with an optical image E for each separated color to form an electrostatic image on the photosensitive drum 106.

Next, a stated developing assembly is operated to develop the electrostatic image formed on the photosensitive drum 106 to form a toner image on the photosensitive drum 106 by the use of a toner. The developing assemblies 111Y, 111C, 111M and 111K sequentially come close to the photosensitive drum 106 in accordance with the respective separated colors by the operation of eccentric cams 115Y, 115C, 115M and 115B, respectively, to perform development.

The transfer unit has a transfer drum 113*a*, a transfer charging assembly 113*b*, an attraction charging assembly 113*c* for electrostatically attracting a recording medium, and an attraction roller 113*g* provided opposite to the assembly 113*c*, an inside charging assembly 113*d*, an outside charging assembly 113*e* and a separation charging assembly 113*h*. The transfer drum 113*a* is supported on a shaft so that it can be rotatively driven, and has a transfer sheet 113*f* serving as a transfer medium holding member that holds the transfer medium at an open zone on the periphery thereof, the transfer sheet being provided on a cylinder under integral adjustment. As the transfer sheet 113*f*, a resin film such as polycarbonate film is used.

The transfer medium is transported from a cassette 116*a*, 116*b* or 116*c* to the transfer drum 113*a* through a transfer sheet transport system, and is held on the transfer drum 113*a*. With the rotation of the transfer drum 113*a*, the transfer medium held on the transfer drum 113*a* is repeatedly transported to the transfer position facing the photosensitive drum 106. While passing through the transfer position, the toner image formed on the photosensitive drum 106 is transferred to the transfer medium by the action of the transfer charging assembly 113*b*.

The toner images may directly be transferred from the photosensitive member to the transfer medium as shown n FIG. 3, or the toner images on the photosensitive member may first be transferred to an intermediate transfer member and then transferred from the intermediate transfer member to the transfer medium.

The above steps of image formation are repeatedly carried out for yellow (Y), magenta (M), cyan (C) and black (K), thus a color image formed by superimposing four color toner images is obtained on the transfer medium held on the transfer drum 113*a*.

The transfer medium to which the four color toner images have been thus transferred is separated from the transfer drum 113*a* by the action of a separation claw 117*a*, a separation push-up roller 117*b* and the separation charging assembly 113*h*, and sent to a heat-and-pressure fixing assembly 100, where the toner images are fixed by heat and pressure and thereby the color mixing of the toners, color formation, and fixing to the transfer medium are carried out until a full-color fixed image is formed. Thereafter, the transfer medium having the image thus formed is outputted to a tray 118. Thus, the formation of a full-color image is completed.

Figure 4:
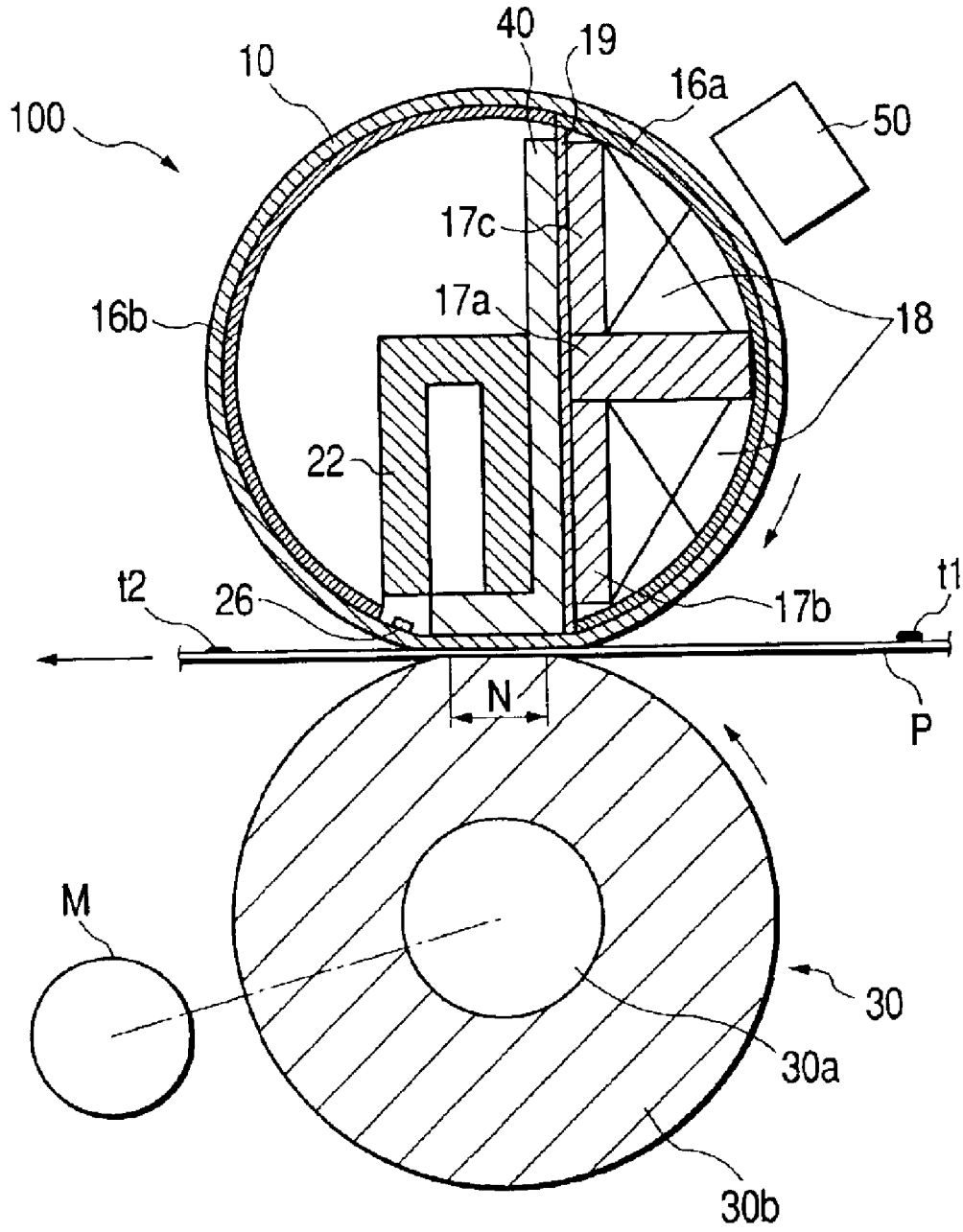
FIG. 4 is a schematic transverse sectional side view of a heating assembly (fixing assembly) of the present invention.
Figure 5:
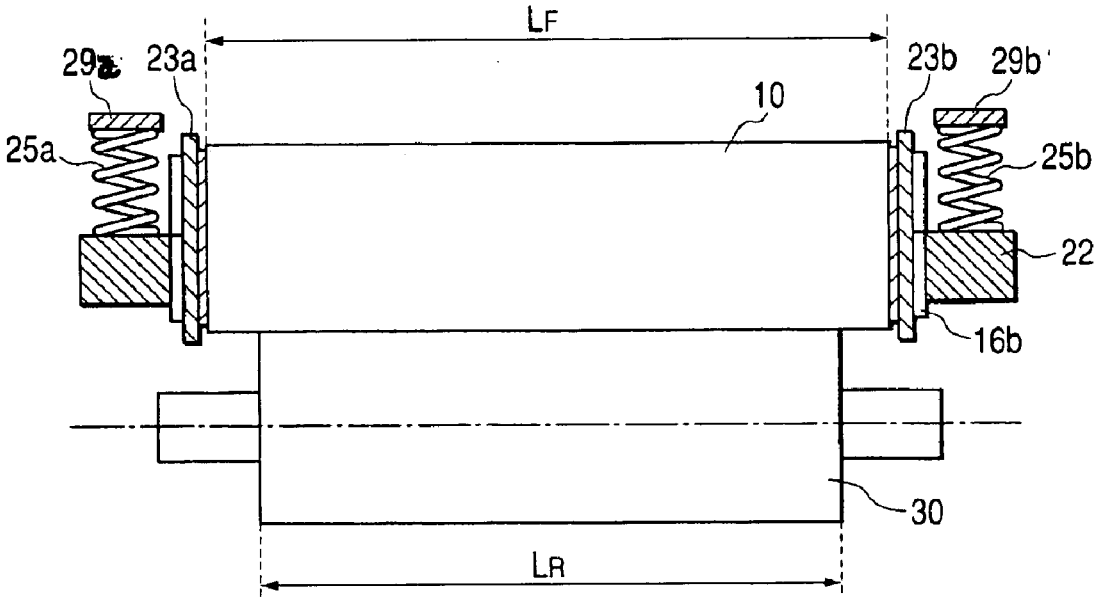
FIG. 5 is a diagrammatic front view of the main part of the heating assembly of the present invention.
Figure 6:
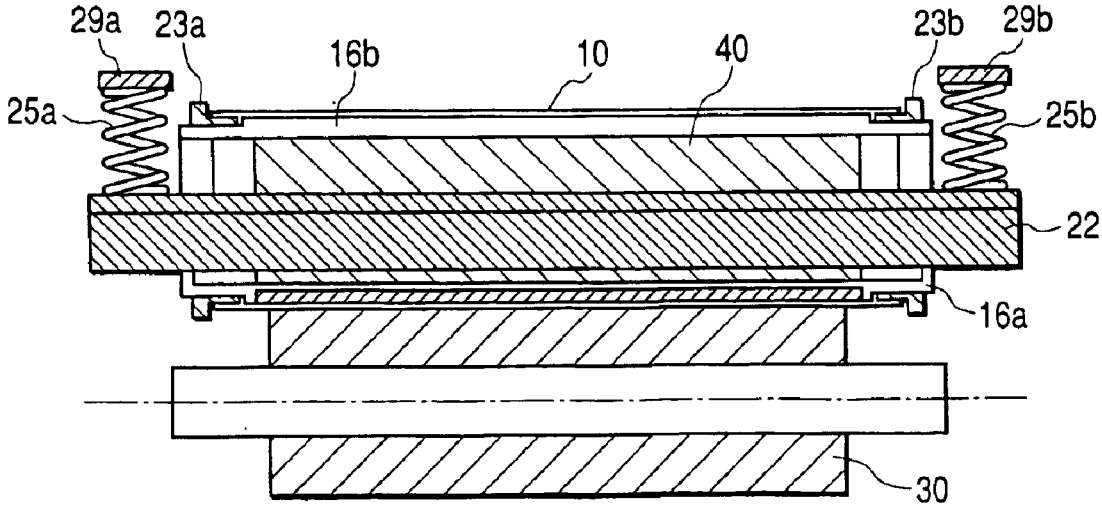
FIG. 6 is a diagrammatic longitudinal sectional front view of the main part of the heating assembly of the present invention.

(2) Fixing Assembly (Heating Means):

In the present invention, the fixing assembly (denoted by 100 in FIG. 3) is one using an electromagnetic-induction heating system. FIG. 4 is a diagrammatic transverse sectional side view of the fixing assembly of an electromagnetic-induction heating system in the present invention. FIG. 5 is a diagrammatic front view of the main part, and FIG. 6 is a diagrammatic longitudinal sectional front view of the main part.

Figure 11:
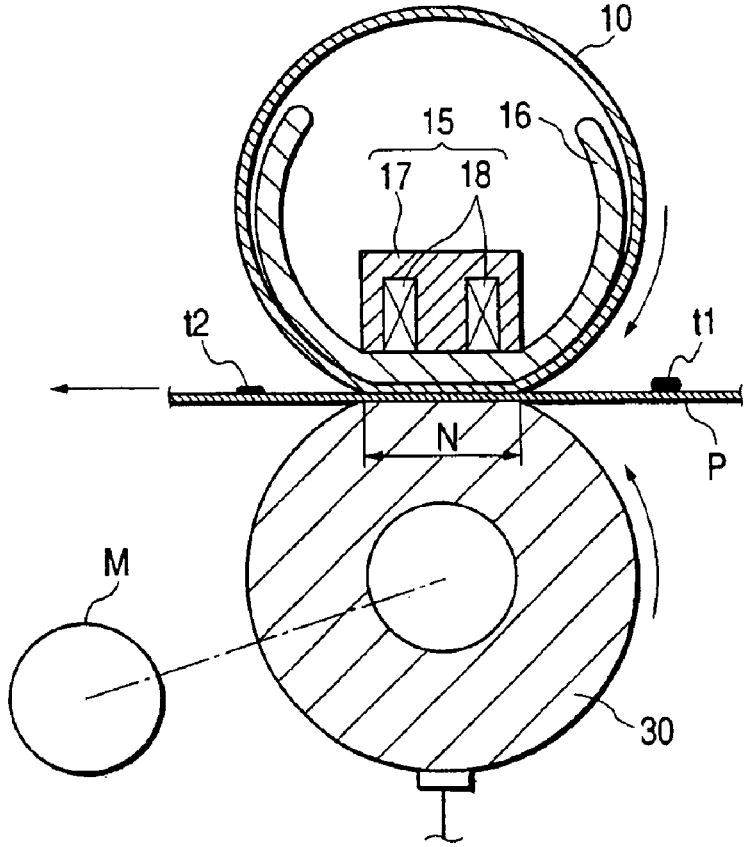
FIG. 11 is a schematic illustration of the construction of a fixing assembly of an electromagnetic-induction heating system.

The assembly of this example, like a fixing assembly shown in FIG. 11, described later, is an assembly of a pressure roller drive system and an electromagnetic-induction heating system, making use of a cylindrical electromagnetic-induction heat generation belt. Constituent members and portions common to those of the assembly shown in FIG. 11 are denoted by like reference numerals to avoid repeating description.

A magnetic-field induction means consists basically of magnetic cores 17*a*, 17*b* and 17*c* and exciting coils 18.

The magnetic cores 17*a*, 17*b* and 17*c* are members having a high magnetic permeability, and may preferably be made of a material used in cores of transformers, such as ferrite or permalloy. More preferably, ferrite may be used, as having less loss even at 100 kHz or more.

Figure 7:
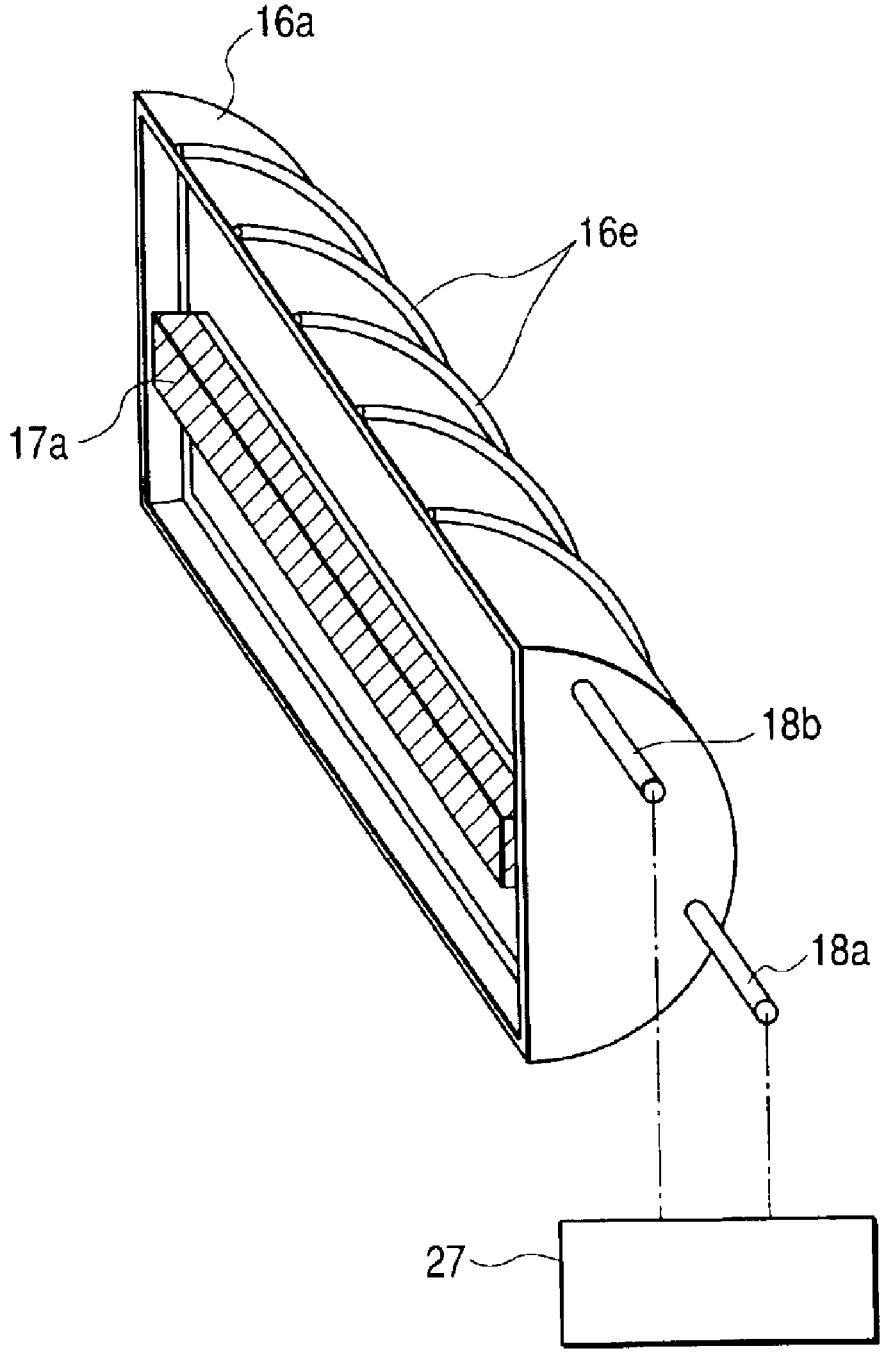
FIG. 7 is a diagrammatic view of a magnetic-field induction means used in the heating assembly of the present invention.

To the exciting coils 18, an exciting circuit 27 is connected through electric-power feed lines 18*a* and 18*b* as shown in FIG. 7. This exciting circuit 27 is so provided as to be able to induce a high-frequency current of from 20 kHz to 500 kHz at a switching power source.

The exciting coils 18 induce an alternating magnetic field by the aid of an alternating current (high-frequency current) fed from the exciting circuit 27.

Reference numerals 16*a* and 16*b* denote bucket type belt guide members having substantially the shape of a semicircle in a transverse sectional view. Their open sides are made to face each other to construct a substantially circular cylinder. A fixing belt 10 which is a cylindrical electromagnetic-induction heat generation belt is loosely externally placed.

The belt guide member 16*a* holds on its inside the magnetic cores 17*a*, 17*b* and 17*c* and the exciting coils 18 which serve as the magnetic-field induction means.

In the belt guide member 16*a*, as shown in FIG. 4, a good heat conduction member 40 (see also FIG. 6) extending lengthwise in the vertical direction as viewed on the paper surface is provided on the inside of the fixing belt 10 and on the side opposite to a pressure roller 30 at a nip N formed between the fixing belt 10 and the pressure roller 30.

In this example, aluminum is used in the good heat conduction member 40. The good heat conduction member 40 has a thermal conductivity k of $k=240\ W\cdot m^{-1}\cdot K^{-1}$ and a thickness of 1 mm.

The good heat conduction member 40 is so provided that it is not affected by the magnetic field induced from the exciting coils 18 and the magnetic cores 17*a*, 17*b* and 17*c* which serve as the magnetic-field induction means, and is disposed outside this magnetic field.

Stated specifically, the good heat conduction member 40 is disposed at a position separate from the exciting coils 18 interposing the magnetic core 17*c* between them. Thus, it is positioned on the outside of a magnetic path formed by the exciting coils 18 so that the good heat conduction member 40 is not affected by the magnetic path.

Reference numeral 22 denotes an oblong, pressing rigid stay disposed in contact with the inner-face flat zone of the belt guide member 16*b*.

Reference numeral 19 denotes an exciting coil holder member which is an insulating member for insulating the magnetic cores 17*a*, 17*b* and 17*c* and exciting coils 18 from the pressing rigid stay 22.

Flange members 23*a* and 23*b* are externally put on the right-and-left both ends of an assemblage constituted of the belt guide members 16*a* and 16*b*, and are rotatively attached setting the assemblage stationary at the right-and-left position. They receive the ends of the fixing belt 10, and have the function of preventing the fixing belt 10 from moving on one side along the long dimension extending between the belt guide members.

The pressure roller 30 as a pressure member is constituted of a mandrel 30*a* coated with a heat-resistant elastic material layer 30*b* formed of silicone rubber, fluorine rubber, fluorine resin or the like, and is so provided as to be rotatively supported on bearings at both ends of the mandrel 30*a* between chassis side metal plates (not shown) of the fixing assembly.

Between both ends of the pressing rigid stay 22 and spring bearing members 29*a* and 29*b*, springs 25*a* and 25*b* are respectively provided in a compressed form so that a press-down force is acted on the pressing rigid stay 22. Thus, the bottom surface of the belt guide member 16*a* and the top surface of the pressure roller 30 come into pressure contact interposing the fixing belt 10 between them, to form a fixing nip N in a stated width.

The pressure roller 30 is rotated in the direction of an arrow by means of a drive means M. Frictional force acting between the pressure roller 30 and the outer surface of the fixing belt 10, generated by rotative drive of the pressure roller 30, causes rotational force to act on the fixing belt 10. The fixing belt 10 comes into rotation around the outer periphery of the belt guide members 16*a* and 16*b* in the direction of an arrow at a peripheral speed corresponding substantially to the rotational peripheral speed of the pressure roller 30, which is rotated with sliding movement while its inner surface is in close contact with the bottom surface of the good heat conduction member 40 at the fixing nip N.

In this case, in order to reduce the mutual sliding frictional force acting between the bottom surface of the good heat conduction member 40 and the inner surface of the fixing belt 10 at the fixing nip N, a lubricant such as heat-resistant grease may be interposed between the bottom surface of the good heat conduction member 40 and the inner surface of the fixing belt 10 at the fixing nip N, or the bottom surface of the good heat conduction member 40 may be covered with a lubricating member. This is to prevent the fixing belt 10 in sliding motion from being scratched and to prevent its durability from deteriorating, where the good heat conduction member 40 has no good surface lubricity in view of its material as in the case where aluminum is used therefor or its surface finishing is simplified.

The good heat conduction member 40 has the effect of making temperature distribution uniform in the lengthwise direction. For example, when a small-size sheet of paper is passed, the heat at non-paper-feed areas in the fixing belt 10 is conducted to the good heat conduction member 40. Then the heat at non-paper-feed areas in the fixing belt 10 is conducted to the small-size paper feed area on account of the heat conduction through the good heat conduction member 40 in its lengthwise direction. Thus, the effect of reducing the electric power consumed when small-size paper is passed is also obtainable.

As shown in FIG. 7, protruding ribs 16*e* may also be formed and provided on the curved surface of the belt guide member 16*a* at stated intervals in its longitudinal direction so that the contact sliding resistance between the curved surface of the belt guide member 16*a* and the inner surface of the fixing belt 10 can be reduced to lessen the rotational load of the fixing belt 10. Such protruding ribs 16*e* may likewise be formed and provided on the belt guide member 16*b*.

Figure 8:
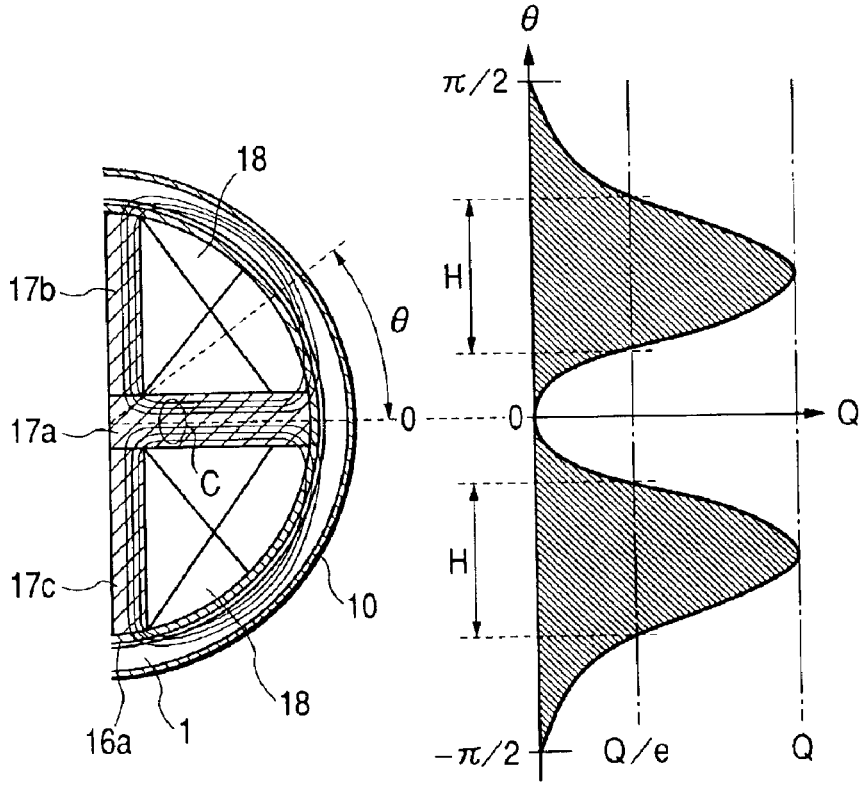
FIG. 8 is a diagrammatic illustration of how an alternating magnetic field is induced.

FIG. 8 diagrammatically illustrates how an alternating magnetic field is induced. A magnetic flux C represents part of the alternating magnetic field having been induced. The alternating magnetic field guided to the magnetic cores 17*a*, 17*b* and 17*c* induces eddy currents in an electromagnetic-induction heat generation layer 1 of the fixing belt 10 across the magnetic core 17*a* and the magnetic core 17*b* and across the magnetic core 17*a* and the magnetic core 17*c*. The eddy currents generate Joule heat (eddy-current loss) in the electromagnetic-induction heat generation layer 1 in virtue of specific resistance of the electromagnetic-induction heat generation layer 1. Quantity of heat generation Q obtained here depends on the density of magnetic flux passing through the electromagnetic-induction heat generation layer 1, and shows distribution as shown by a graph in FIG. 8. In the graph in FIG. 8, the abscissa indicates positions in the peripheral direction in the fixing belt 10, represented by angles θ with respect to the center, regarded as 0, of the magnetic core 17*a*, and the ordinate indicates the quantity of heat generation Q in the electromagnetic-induction heat generation layer of the fixing belt 10. Here, when the maximum quantity of heat generation is represented by Q, a heat generation region H is defined to be a region in which the quantity of heat generation is Q/e or more. This is the region where the quantity of heat generation necessary for fixing is obtainable.

The temperature at the fixing nip N is so controlled that a preset temperature is maintained by controlling the feed of electric current to the exciting coils 18, using a temperature control system (not shown) having a temperature detection means. Reference numeral 26 (FIG. 4) denotes a temperature sensor such as a thermistor, which detects the temperature of the fixing belt 10. In this example, the temperature of the fixing nip N is controlled on the basis of the information on the temperature of the fixing belt 10, measured by the temperature sensor 26.

The fixing belt 10 is rotated, where electric power is fed to the exciting coils 18 from the exciting circuit 27 to bring the fixing belt 10 into electromagnetic-induction heat generation as described above, to cause the fixing nip N to rise to a preset temperature and its temperature is controlled. In this state, a recording medium P on which unfixed toner images t1 have been formed, having been transported from an image-forming means section (not shown), is guided to the zone between the fixing belt 10 and the pressure roller 30 at the fixing nip N, with its image side up, i.e., facing the fixing belt outer surface, and is sandwiched and transported through the fixing nip N together with the fixing belt 10 in the state the image surface is in close contact with the outer surface of the fixing belt 10 at the fixing nip N. While the recording medium P is sandwiched and transported through the fixing nip N together with the fixing belt 10, it is heated by electromagnetic-induction heat generation of the fixing belt 10, and the unfixed toner images t1 on the recording medium P is heated and fixed. After the recording medium P has passed through the fixing nip N, it is separated from the outer surface of the fixing belt 10 being rotated and is discharged and transported. Heat-fixed toner images t2 on the recording medium is, after it has passed through the fixing nip N, cooled to come into permanently fixed images.

In this example, as shown in FIG. 4, a thermoswitch 50, a temperature detection device, is provided at a position facing the heat generation region H (FIG. 8) of the fixing belt 10, in order to shut off electric power fed to the exciting coils 18 at the time of runaway.

Figure 9:
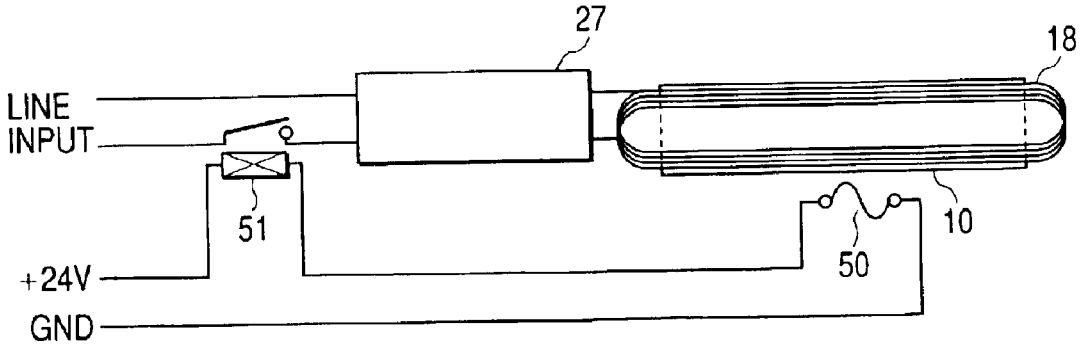
FIG. 9 is a circuit diagram of a safety circuit used in the heating assembly of the present invention.

FIG. 9 is a circuit diagram of a safety circuit used in this example. The circuit is so constructed that the temperature detection device thermoswitch 50 is connected to a +24 V DC power source and a relay switch 51 in series, and, upon turn-off of the theremoswitch 50, the electric power fed to an exciting circuit 27 is shut off so that the electric power fed to the exciting coils 18 is shut off. The thermoswitch 50 is set at OFF-operation temperature of 220° C.

The thermoswitch 50 is also provided in non-contact with the outer surface of the fixing belt 10, facing the heat generation region H of the fixing belt 10. The distance between the thermoswitch 50 and the fixing belt 10 is set to be about 2 mm. This enables the fixing belt 10 not to be scratched by contact with the thermoswitch 50, to prevent fixed imaged from deteriorating upon extensive operation.

According to this example, at the time of runaway of the fixing assembly because of any machine trouble, even when the fixing assembly stops in the state the paper is sandwiched at the fixing nip N and the electric power is kept fed to the exciting coils 18 and the fixing belt 10 continues to generate heat, heat is generated at the fixing nip N where the paper is sandwiched, and hence the paper is by no means directly heated, differently from the construction in which heat is generated at the fixing nip N as shown in FIG. 11. Also, since the thermoswitch 50 is provided at the heat generation region H, having a large quantity of heat generation, the thermoswitch 50 detects the temperature 220° C. and the thermoswitch 50 is turned off, when the electric power fed to the exciting coils 18 is shut off by the relay switch 51.

According to this example, since the ignition temperature of paper is around 400° C., the paper by no means catches fire, and the generation of heat of the fixing belt 10 can be stopped before that.

As the temperature detection device, a temperature fuse may be used besides the thermoswitch.

In this example, the toner containing a low-softening substance (the wax) is used, and hence any oil application mechanism for preventing offset is not provided in the fixing assembly. When a toner containing no low-softening substance is used, such an oil application mechanism may be provided. Also when the toner containing the low-softening substance is used, oil may be applied or separation by cooling may be performed.

A) Exciting Coil:

To form the exciting coil 18, a bundle of a plurality of thin wires (bundled wire) made of copper and one by one individually insulation-coated are used as conductor wires (electric wires) for making up a coil (wound wire), and this is wound in a plurality of turns. In this example, this is wound in 10 turns to form the exciting coil 18.

To provide the insulation coating, a coating having heat insulation properties may preferably be used, taking into account the conduction of heat generated by the fixing belt 10. For example, a coating of amide-imide or polyimide may preferably be used.

The exciting coil 18 may be pressed from the outside so as to be improved in denseness.

The exciting coil 18 has the shape after the curved surface of the heat generation layer as shown in FIG. 4. In this example, the distance between the heat generation layer of the fixing belt 10 and the exciting coil 18 is set to be about 2 mm.

The exciting coil holder member 19 may preferably be made of a material having excellent insulation properties and good heat resistance. For example, resins such as phenolic resin, fluorine resin, polyimide resin, polyamide resin, polyamide-imide resin, PEEK resin, PES resin, PPS resin, PFA resin, PTFE resin, FEP resin and LCP resin may be selected.

The distance between i) the magnetic cores 17*a*, 17*b* and 17*c* and exciting coils 18 and ii) the heat generation layer of the fixing belt 10 may preferably be set as short as possible to absorb the magnetic field at a high efficiency. If this distance is more than 5 mm, this efficiency may extremely lower, and hence it may preferably be set within 5 mm. Also, as long as the distance is within 5 mm, the distance between the heat generation layer of the fixing belt 10 and the exciting coils 18 need not be constant.

With regard to lead-out wires from the exciting coils 18, i.e., the electric-power feed lines 18*a* and 18*b*, bundled wires are insulation-coated on their outside in respect of the part outside the exciting coil holder member 19.

Figure 10:
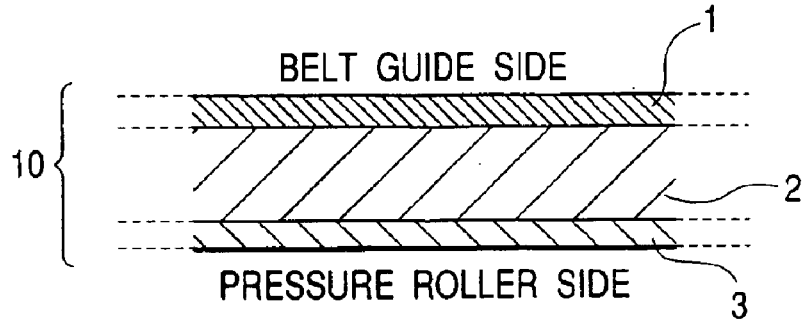
FIG. 10 is a diagrammatic view of the layer construction of a fixing belt (fixing film) used in the heating assembly of the present invention.

B) Fixing Belt:

FIG. 10 is a diagrammatic view of the layer construction of the fixing belt 10 in this example. The fixing belt 10 in this example has composite structure consisting of a heat generation layer 1 formed of a metal belt or the like, serving as a base layer of the electromagnetic-induction heatgenerating fixing belt 10, an elastic layer 2 superposed on the outer surface of the heat generation layer 1, and a release layer 3 superposed on the outer surface of the elastic layer 2. For the purpose of the bonding between the heat generation layer 1 and the elastic layer 2 and the bonding between the elastic layer 2 and the release layer, a primer layer (not shown) may be provided between the layers. In the fixing belt 10 substantially in the shape of a hollow cylinder, the heat generation layer 1 is on the side of inner surface and the release layer 3 is on the side of outer surface of the belt. As described previously, the alternating magnetic field acts on the heat generation layer 1 to induce eddy currents in the heat generation layer 1, and the heat generation layer 1 generates heat. The heat thus generated heats the fixing belt 10 through the elastic layer 2 and release layer 3, and heats the recording medium P as the heat-receiving medium having passed through the fixing nip N, thus the toner images are heated and fixed.

a. Heat Generation Layer:

The heat generation layer 1 may preferably be made of a non-magnetic metal, and may more preferably be made of a metal of ferromagnetic material, such as nickel, iron, magnetic stainless steel or a cobalt-nickel alloy, capable of well absorbing the magnetic field.

The thickness of the heat generation layer may preferably be larger than the surface skin depth represented by the following equation and not more than 200 μm. The surface skin depth is represented as:

$$\sigma=503\times(\rho/f\mu)^{1/2}$$

where σ is the surface skin depth (m), f is the frequency (Hz) of the exciting circuit, μ is the magnetic permeability, and ρ is the specific resistance (Ω·m).

This represents the depth of absorption of electromagnetic waves used in the electromagnetic induction. At a depth larger than this, the intensity of electromagnetic waves comes to be 1/e or less. In other words, most of energy is absorbed at the part up to this depth.

The heat generation layer 1 may preferably have a thickness of from 1 μm to 200 μm. If the heat generation layer 1 has a thickness smaller than 1 μm, most of electromagnetic energy is not completely absorbed, resulting in a poor efficiency. If on the other hand the heat generation layer 1 has a thickness larger than 200 μm, the layer may have too high rigidity, and may have so poor flexing properties that it is not practical to use it as a rotating member.

b. Elastic Layer:

The elastic layer 2 may be formed of silicone rubber, fluorine rubber, fluorosilicone rubber or the like, which is a material having good heat resistance and good thermal conductivity.

The elastic layer 2 may preferably have a thickness of from 10 μm to 1,000 μm. This thickness of the elastic layer 2 is the thickness necessary for ensuring the quality of fixed images.

When color images, in particular, photographic images are printed, solid images are formed on the recording medium over a large area. In such a case, the heating may become non-uniform unless the heating surface (release layer 3) can not follow any unevenness of recording medium surface or unevenness of toner layer surface, to cause non-uniform gloss in images between part of heat conduction in a large quantity and part of that in a small quantity. Part of heat conduction in a large quantity has a high glossiness and part of heat conduction in a small quantity has a low glossiness. If the elastic layer 2 has a thickness smaller than 10 μm, the heating surface can not completely follow the unevenness of the recording medium surface or the toner layer surface to cause image gloss non-uniformity. If on the other hand the elastic layer 2 has a thickness larger than 1,000 μm, the elastic layer 2 may have a high resistance to heat to make it difficult to materialize the quick start. More preferably, the elastic layer 2 may have a thickness of from 50 μm to 500 μm.

As to the hardness of the elastic layer 2, if the elastic layer 2 is too hard, it can not completely follow the unevenness of toner layer surface to cause image gloss non-uniformity. Accordingly, the elastic layer 2 may preferably have a hardness of 60° (JIS-A) or less, and more preferably 45° (JIS-A).

With regard to the thermal conductivity λ of the elastic layer 2, it may preferably be 0.25 to 0.82 J/m·sec·deg.

If the thermal conductivity λ is lower than 0.25 J/m·sec·deg., the elastic layer 2 may have a high resistance to heat, and the temperature of the surface layer (release layer 3) of the fixing belt may slowly rise. If the thermal conductivity λ is higher than 0.82 J/m·sec·deg., the elastic layer 2 may have a too high hardness, or may have a high compression set.

Accordingly, the elastic layer 2 may preferably have the the thermal conductivity λ of 0.25 to 0.82 J/m·sec·deg., and more preferably a thermal conductivity λ of 0.33 to 0.63 J/m·sec·deg.

c. Release Layer:

The release layer 3 may be formed of a material having good releasability and heat resistance, such as fluorine resin, silicone resin, fluorosilicone rubber, fluorine rubber, silicone rubber, PFA, PTFE or FEP.

The release layer 3 may preferably have a thickness of from 1 μm to 100 μm. If the release layer 3 has a thickness smaller than 1 μm, there may occur problems such that its some part has a poor releasability because of non-uniform coating of coating film and the layer lacks in durability. If on the other hand the release layer 3 has a thickness larger than 10 μm, a problem of poor heat conduction may occur, and especially in the case of a resin type release layer, the layer may have too high hardness to bring out the effect attributable to the elastic layer 2.

d. Heat Insulation Layer:

In the construction of the fixing belt 10, a heat insulation layer (not shown) may also be provided on the belt guide surface side of the heat generation layer 1 (the surface side opposite to the elastic layer 2, of the heat generation layer 1).

The heat insulation layer may be formed of a heat resistant resin such as fluorine resin, polyimide resin, polyamide resin, polyamide-imide resin, PEEK resin, PES resin, PPS resin, PFA resin, PTFE resin or FEP resin.

The heat insulation layer may also preferably have a thickness of from 10 μm to 1,000 μm. If the heat insulation layer has a thickness smaller than 10 μm, no effect of heat insulation may be obtainable, also resulting in lack of durability. If on the other hand it has a thickness larger than 1,000 μm, the distance from the magnetic cores 17*a*, 17*b* and 17*c* and exciting coils 18 to the heat generation layer 1 is so large that the magnetic field can not well be absorbed in the heat generation layer 1.

The heat insulation layer can insulate heat in such a way that the heat generated in the heat generation layer 1 does not come toward the inside of the fixing belt. Hence, the heat can be fed to the recording medium P side in a better efficiency than the case where any heat insulation layer is not provided. Therefore, power consumption can be made lower.

C) Nip:

The fixing nip N formed by the rotary heating member and the pressure member in the heat fixing assembly used in the present invention may respectively be formed in a nip width of from 5.0 mm to 15.0 mm in order to ensure good fixing performance. If the fixing nip N has a width smaller than 5.0 mm, the heat for fixing toner can not be imparted to the unfixed toner images in a sufficient quantity. If the fixing nip N has a width more than 5.0 mm, the heat for fixing toner can be imparted in a sufficient quantity, but hot offset tends to occur at the time of fixing.

D) Surface Pressure:

The pressure (surface pressure) at the nip in the heat fixing assembly used in the present invention may preferably be within the range of from 9,000 $N/m^2$ to 500,000 $N/m^2$. A surface pressure of less than 9,000 $N/m^2$ is not preferable because the transport of the recording medium tends to deviate and also faulty fixing due to insufficient fixing pressure may occur. The surface pressure more than 500,000 $N/m^2$ is also not preferable because the fixing belt may greatly deteriorate during running.

The surface pressure referred to herein is represented by the value obtained by dividing the pressure applied to the whole transfer medium (recording medium) by the area of the surface coming into contact.

FIG. 11 schematically illustrates an example of the construction of a fixing assembly of an electromagnetic-induction heating system in which the alternating magnetic field distribution attributable to the exciting coils is concentrated in to the vicinity of the fixing nip to improve fixing efficiency.

Reference numeral 10 denotes a cylindrical fixing film as an electromagnetic-induction heating rotary member having an electromagnetic-induction heat generation layer (consisting of a conductor layer, a magnetic-material layer and a resistor layer).

Reference numeral 16 denotes a bucket type film guide member having the shape of substantially a semicircle in a transverse sectional view. The cylindrical fixing film is loosely externally placed on the outside of the film guide member.

Reference numeral 15 denotes a magnetic-field induction means provided on the inside of the film guide member 16. It consists basically of exciting coils 18 and an E-shaped magnetic core (core material) 17. Reference numeral 30 denotes an elastic pressure roller 30, which is kept in mutual pressure contact with the bottom surface of the film guide member 16 interposing the fixing film 10 between them, to form a fixing nip N in a stated width under a stated pressure contact force. The magnetic core 17 of the magnetic-field induction means 15 is so provided as to be positioned corresponding to the fixing nip N.

The pressure roller 30 is rotated in the direction of an arrow by means of a drive means M. Frictional force acting between the pressure roller 30 and the outer surface of the fixing film 10 as the pressure roller 30 is rotatively driven causes a rotational force to act on the fixing film 10. Thus, the fixing film 10 comes into rotation on the circumference of the film guide member 16 in the direction of an arrow at a peripheral speed corresponding substantially to the rotational peripheral speed of the pressure roller 30, which is rotated with sliding movement while its inner surface is in close contact with the bottom surface of the film guide member 16 at the fixing nip N (a pressure roller drive system).

The film guide member 16 has the function to support the exciting coils 18 and magnetic core 17 as the magnetic-field induction means 15 serving also as a pressure means against the fixing nip N, to support the fixing film 10 and to achieve transport stability when the fixing film 10 is rotated. This film guide member 16 is an insulating member which does not obstruct the passage of the magnetic field (magnetic flux), and is formed using a material resistant to a high load.

The exciting coils 18 induce an alternating magnetic field by the aid of the alternating electric current fed from an exciting circuit (not shown). The alternating electric current is distributed concentratedly around the fixing nip N by the aid of the E-shaped magnetic core 17 positioned correspondingly to the fixing nip N. This alternating magnetic field induces eddy currents in the electromagnetic-induction heat generation layer of the fixing film 10. The eddy currents generate Joule heat in the electromagnetic-induction heat generation layer in virtue of specific resistance of the electromagnetic-induction heat generation layer.

The electromagnetic-induction heat generation of this fixing film 10 takes place concentratedly at the fixing nip N where the alternating magnetic field is concentratedly distributed. Thus, the fixing nip N is highly efficiently heated.

The temperature at the fixing nip N is so controlled that a preset temperature is maintained by controlling the feed of electric current to the exciting coils 18, using a temperature control system (not shown) having a temperature detection means.

The fixing belt 10 is rotatively driven. As it is rotated, the cylindrical fixing film 10 is rotated around the outer periphery of the film guide member 16, where electric power is fed to the exciting coils 18 from the exciting circuit to bring the fixing film 10 into electromagnetic-induction heat generation as described above, to cause the fixing nip N to rise to a preset temperature and its temperature is controlled. In this state, a recording medium P on which unfixed toner images t1 have been formed, having been transported from an image-forming means section (not shown), is guided to the zone between the fixing film 10 and the pressure roller 30 at the fixing nip N, with its image side up, i.e., facing the fixing film outer surface, and is sandwiched and transported through the fixing nip N together with the fixing film 10 in the state the image surface is in close contact with the outer surface of the fixing film 10 at the fixing nip N. While the recording medium P is sandwiched and transported through the fixing nip N together with the fixing film 10, it is heated by electromagnetic-induction heat generation of the fixing film 10, and the unfixed toner images t1 on the recording medium P is heated and fixed. After the recording medium P has passed through the fixing nip N, it is separated from the outer surface of the fixing film 10 being rotated and is discharged and transported.

Methods of measuring various physical properties in the binder resin and toner particles are described below.

(1) Measurement of THF-insoluble Matter:

A sample is weighed in an amount of about 0.5 g, which is then put in a cylindrical filter paper (e.g., No. 86R, available from Toyo Roshi K.K.) and set on a Soxhlet extractor. Extraction is carried out on 8 hours and 24 hours using 200 ml of THF as a solvent, and the THF-insoluble matter A, the THF-insoluble matter B and the value of B/A are calculated.

Here, the extraction is carried out at a reflux rate such that the extraction cycle with THF is once every about 4 to 5 minutes.

(2) Measurement of Dynamic Elastic Modulus of Toner:

Using a viscoelasticity measuring instrument (rheometer) RDA-II (manufactured by Rheometrics Co.), the dynamic elastic modulus G' within the temperature range of 60 to 210° C. is measured under the following conditions.

Measuring Jig:

Where the toner has a high elastic modulus, a flat circular plate of 7.9 mm in diameter is used and where it has a low elastic modulus, a flat circular plate of 40 mm in diameter is used. On the actuator side, a shallow cup corresponding to the circular plate is used. The gap between the bottom of the shallow cup and the circular plate is about 2 mm.

Measuring Sample:

After the toner has been heated and melted, a columnar sample of about 8 mm in diameter and 2 mm in height or a disk-shaped sample of 40 mm in diameter and about 2 mm in height is molded and used.

Measurement Frequency: 6.28 Radians/second.

Setting of Measurement Strain:

The initial value is set at 0.1%, and thereafter the measurement is made in an automatic measurement mode.

Correction of Elongation of Sample:

Adjusted in an automatic measurement mode.

Measurement Temperature:

Heated at a rate of 2° C. per minute from 69° C. to 210° C.

(3) Measurement of Molecular Weight by GPC:

Molecular weight of a chromatogram is measured by gel permeation chromatography (GPC) under the following conditions.

Columns are stabilized in a heat chamber of 40° C. To the columns kept at this temperature, tetrahydrofuran (THF) as a solvent is flowed at a flow rate of 1 ml per minute. The 50 μl to 200 μl of a THF sample solution of resin which has been regulated to have a sample concentration of form 0.05 to 0.6% by weight is injected thereinto to make a measurement. In measuring the molecular weight of the sample, the molecular weight distribution the sample has is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Toso Co., Ltd., and to use at least about 10 standard polystyrene samples. An RI (refractive index) detector is used as a detector.

As columns, in order to make a precise measurement in the region of molecular weight region from 1,000 to 2,000,000, it is desirable to use a plurality of commercially available polystyrene gel columns in combination. For example, preferred is the use of a combination of μ-Styragel 500, 1,000, 10,000 and 100,000, available from Waters Co., or a ombination of Shodex KA-801, KA-802, KA-803, KA-804, KA-805, KA-806 and KA-807, available from Showa Denko K.K.

(4) Measurement of Maximum Endothermic Peak and its Half Width of Wax and Toner:

Measurement is conducted using a differential thermal analyzer (DSC measuring instrument) DSC-7, manufactured by Perkin Elmer Co.

A sample for measurement is precisely weighed in an amount of 5 to 20 mg, preferably 10 mg. This sample is put in a pan made of aluminum and an empty aluminum pan is used as reference. Measurement is made in a normal-temperature and normal-humidity environment at a heating rate of 10 C/min within the measuring temperature range of from 30° C. to 200° C. In the course of this heating, a main-peak endothermic peak is obtained within the temperature range of from 30° C. to 160° C.

The half width of the maximum endothermic peak is a temperature width in which the peak is present in ½ or more of the height from the base line to the peak top. As long as the peak is continuous, the peak present in ½ or more of the height need not be continuous in the whole region of the half width.

(5) Measurement of Particle Size Distribution of Toner Particles or Toner:

As a measuring instrument, a COULTER COUNTER TA-II or COULTER MULTIISIZER (manufactured by Coulter Electronics, Inc.) Is used. As an electrolytic solution, an aqueous 1% NaCl solution is prepared using first-grade sodium chloride. For example, ISOTON (registered trademark)-II (available from Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles for each channel by means of the above measuring instrument, using an aperture of 100 μm as its aperture. Then the weight-based, weight-average particle diameter (D4) and volume-average particle diameter (Dv) the middle value in each channel is used as a representative value for each channel according to the present invention, determined from the volume distribution of toner particles, are determined.

As channels, the following 13 channels are used: 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

EXAMPLES

The toner and fixing method of the present invention are described below by giving Examples. The present invention is by no means limited to these Examples.

Toner Production Example 1

Polyester resin No. 1 having the following monomer component ratio was prepared.

Diol component represented by the formula:

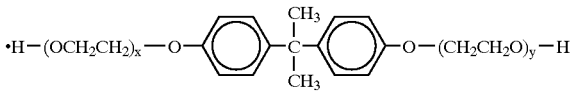

| | |
|---|---|
| (x + y = 3.0) | 59 mol % |
| Fumaric acid | 21 mol % |
| Terephthalic acid | 11 mol % |
| Trimellitic acid | 9 mol % |

The non-linear polyester resin No. 1 thus obtained had a Tg of 60° C. and had, in the GPC of THF-soluble matter, Mn of 3,300 and Mw of 33,000; the Mw/Mn being 10.0. This was produced by subjecting the diol component to polycondensation with the fumaric acid and terephthalic acid, and adding the trimellitic acid at the latter half of the reaction to effect cross-linking, obtaining the non-linear polyester resin No. 1.

| | (by weight) |
|---|---|
| Binder resin: polyester resin No. 1 | 100 parts |
| Wax: paraffine wax (A) (Table 1) | 3 parts |
| Charge control agent: aromatic oxycarboxylic acid aluminum (A1) compound (I) | 6 parts |
| Pigment: copper phthalocyanine | 5 parts |

Al Compound (I)

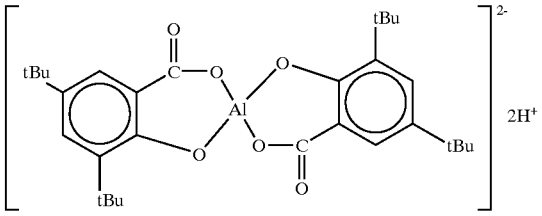

The above materials were mixed by means of a Henschel mixer, the mixture obtained was melt-kneaded by means of a twin-screw extruder at a barrel temperature of 120° C., the melt-kneaded product obtained was cooled, the cooled product obtained was crushed using a hammer mill in particle diameters of about 1 to 2 mm, followed by pulverization by means of a fine grinding mill of an air jet system. The pulverized product obtained was classified using a multi-division classifier to remove fine powder and coarse powder simultaneously and strictly. Thus, cyan color toner particles with a weight-average particle diameter of 7.8 μm was obtained.

To the toner particles thus obtained, 1.5% by weight of fine titanium oxide particles with a primary particle diameter of 50 nm, having been surface-treated with isobutyltrimethoxysilane, was externally added, and these were mixed to produce a cyan toner 1.

The cyan toner 1 and magnetic ferrite carrier particles (average particle diameter: 50 μm) having been surface-treated with silicone resin were so blended as to be in a toner concentration of 6% by weight, to make up a two-component type cyan developer 1.

Toner Production Examples 2 and 3

Cyan toners 2 and 3 and cyan developers 2 and 3 were prepared respectively in the same manner as in Toner Production Example 1 except that the amount of the aromatic oxycarboxylic acid Al compound (I) added as a charge control agent was changed as shown in Table 1.

Toner Production Examples 4 and 5

Cyan toners 4 and 5 and cyan developers 4 and 5 were prepared respectively in the same manner as in Toner Production Example 1 except that an ester wax shown in Table 1 was used in place of the paraffin wax (A) and the barrel temperature 120° C. was changed to 100° C. and 180° C., respectively.

Toner Production Example 6

A cyan toner 6 and a cyan developer 6 were prepared in the same manner as in Toner Production Example 1 except that in place of the aromatic oxycarboxylic acid Al compound (I) an aromatic oxycarboxylic acid chromium compound (II) was used as the charge control agent.

Cr Compound (II)

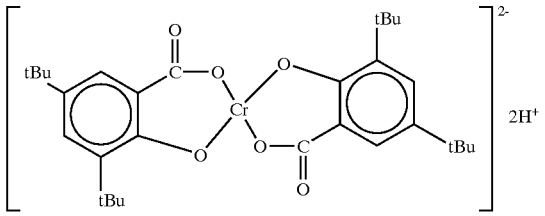

Toner Production Example 7

A cyan toner 7 and a cyan developer 7 were prepared in the same manner as in Toner Production Example 1 except that in place of the paraffin wax (A) a paraffin wax (B) as shown in Table 1 was used.

Toner Production Example 8

A cyan toner 8 and a cyan developer 8 were prepared in the same manner as in Toner Production Example 1 except that in place of the paraffin wax (A) a paraffin wax (C) as shown in Table 1 was used.

Toner Production Example 9

A cyan toner 9 and a cyan developer 9 were prepared in the same manner as in Toner Production Example 1 except that in place of the polyester resin No. 1 a polyester resin No. 2 was used, which had a Tg of 53° C. and had, in the GPC of THF-soluble matter, Mn of 3,000 and Mw of 9,300; the Mw/Mn being 3.1.

Toner Production Example 10

A cyan toner 10 and a cyan developer 10 were prepared in the same manner as in Toner Production Example 1 except that in place of the polyester resin No. 1 a polyester resin No. 3 was used, which had a Tg of 66° C. and had, in the GPC of THF-soluble matter, Mn of 6,000 and Mw of 24,000; the Mw/Mn being 4.0.

Toner Production Example 11

A magenta toner 1 and a magenta developer 1 were prepared in the same manner as in Toner Production Example 1 except that in place of 5 parts by weight of the copper phthalocyanine 5 parts by weight of quinacridone was used as the pigment. Also, a yellow toner 1 and a yellow developer 1 were prepared in the same manner as in Toner Production Example 1 except that in place of 5 parts by weight of the copper phthalocyanine 5 parts by weight of PIGENT YELLOW 17 was used. Still also, a black toner 1 and a black developer 1 were prepared in the same manner as in Toner Production Example 1 except that in place of 5 parts by weight of the copper phthalocyanine 5 parts by weight of carbon black was used.

Comparative Toner Production Example 1

A cyan toner 11 and a cyan developer 11 were prepared in the same manner as in Toner Production Example 1 except that the amount of the aromatic oxycarboxylic acid Al compound (I) added as a charge control agent was changed as shown in Table 1.

Comparative Toner Production Example 2

A cyan toner 12 and a cyan developer 12 were prepared in the same manner as in Toner Production Example 1 except that the charge control agent was not used.

Comparative Toner Production Examples 3 and 4

Cyan toners 13 and 14 and cyan developers 13 and 14 were prepared respectively in the same manner as in Toner Production Example 1 except that in place of the aromatic oxycarboxylic acid Al compound (I) an aromatic oxycarboxylic acid zinc (Zn) compound (III) and iron (Fe) compound (IV), respectively, having the following structure was used.

Zn Compound (III)

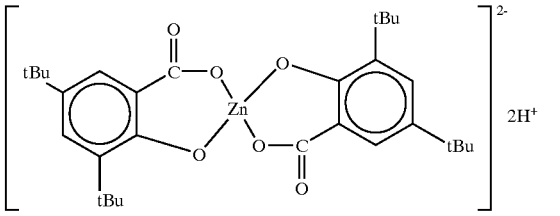

Fe Compound (IV)

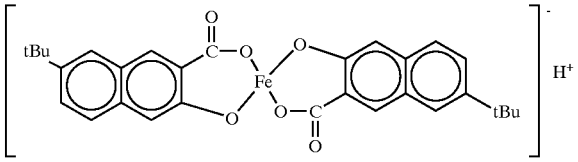

Comparative Toner Production Examples 5 and 6

Cyan toners 15 and 16 and cyan developers 15 and 16 were prepared respectively in the same manner as in Comparative Toner Production Example 2 except that in place of the paraffin wax (A) a paraffin wax (D) and a paraffin wax (E) as shown in Table 1 were used.

Comparative Toner Production Example 7

A cyan toner 17 and a cyan developer 17 were prepared in the same manner as in Toner Production Example 1 except that in place of the paraffin wax (A) a polyethylene wax shown in Table 1 was used.

Comparative Toner Production Example 8

A cyan toner 18 and a cyan developer 18 were prepared in the same manner as in Toner Production Example 1 except that in place of the paraffin wax (A) a polypropylene wax shown in Table 1 was used.

Comparative Toner Production Example 9

A cyan toner 19 and a cyan developer 19 were prepared in the same manner as in Comparative Toner Production Example 2 except that in place of the polyester resin No. 1 a polyester resin No. 4 was used, which had a Tg of 50° C. and had, in the GPC of THF-soluble matter, Mn of 1,500 and Mw of 2,900; the Mw/Mn being 1.9.

Comparative Toner Production Example 10

A cyan toner 20 and a cyan developer 20 were prepared in the same manner as in Comparative Toner Production Example 2 except that in place of the polyester resin No. 1 a polyester resin No. 5 was used, which had a Tg of 70° C. and had, in the GPC of THF-soluble matter, Mn of 10,000 and Mw of 220,000; the Mw/Mn being 22.0.

Comparative Toner Production Example 11

A cyan toner 21 and a cyan developer 21 were prepared in the same manner as in Comparative Toner Production Example 2 except that in place of the polyester resin No. 1 a styrene-n-butyl acrylate copolymer was used, which had a Tg of 60° C. and had, in the GPC of THF-soluble matter, Mn of 10,000 and Mw of 300,000; the Mw/Mn being 30.0.

Example 1

Types of binder resins, types, endothermic peaks and half widths of waxes, types and amounts (pbw) of charge control agents, which were used in the cyan toner 1, and the barrel temperature set for a kneading machine are shown in Table 1. Also, values of various physical properties of the cyan toner 1 obtained are shown in Table 2.

Referring to evaluation of the fixable temperature range and the color reproduction range attributable to secondary-color color mixing properties, the two-component type cyan developer 1 was put in a commercially available, plain-paper full-color copying machine (a color laser copying machine CLC700, manufactured by CANON INC.) from which its fixing unit was detached, and unfixed images were formed in a monochromatic mode in a normal temperature and normal humidity (23° C., 60% RH) environment. Then, using a fixing test assembly constructed as shown in FIG. 4, fixed images were formed changing the preset temperature, and evaluation was made on fixing performance, image gloss and OHP transparency (transmittance). Toner's anti-blocking properties were also evaluated. Details of construction of the fixing assembly were as shown below. Process speed was set at 120 mm/sec.

Magnetic cores 17*a*, 17*b* and 17*c* as a magnetic-filed induction means were made of ferrite, and the bundled wire was wound by 10 turns to form the exciting coils 18.

As the construction of the fixing belt 10, it had such a layer structure as shown in FIG. 10. A nickel layer of 10 $\mu$m in thickness was used as the heat generation layer 1.

The elastic layer 2 was formed of silicone rubber in a thickness of 200 $\mu$m, using one having a hardness of 35 degrees according to JIS K-6301.

As the release layer 3, it was formed by applying PFA resin in a thickness of 20 $\mu$m on the elastic layer 2.

As the pressure roller 30, a roller having a roller hardness of 60 degrees (Asker-C500 g) was used which was obtained by covering a mandrel 30*a* made of iron, with silicone rubber and PFA resin. As the pressure against the pressure roller, the pressing springs 25*a* and 25*b* were adjusted to bring the fixing belt 10 into pressure contact with the pressure roller 30 at a surface pressure of 120,000 N/m$^2$ to form a fixing nip N of 8 mm in a state that a sheet of paper of 80 g/cm$^2$ was held between them.

In this Example, the fixing belt was not provided with any oil application unit.

The fixing assembly constructed in this way was able to rise to the preset temperature in a short time.

To measure the image gloss (glossiness), a Model VG-10 glossiness meter (manufactured by Nippon Denshoku K.K.) is used, and solid images used for measuring chromaticity are used as samples to carry out measurement.

In the measurement, voltage is set at 6 V by means of a constant-voltage transformer. Next, the light projection angle and light reception angle are each adjusted to 75. After adjusting the zero point and setting the standard by the use of a standard plate, a sample image is placed on a sample stand, and three sheets of white paper are superposed thereon. Numerical values indicated at an indication area are read in units of %. Here, a S—S/10 switching SW is set to S, and an angle—sensitivity switching SW is set to 45–60.

Also, samples with an image density of 1.5±0.1 are used.

As to image gloss difference, heating-zone preset temperature is set to 160° C., and the difference in average gloss value between the image gloss on the first sheet immediately after start and that on the 50th sheet after 50 continuous 50-sheet printing is evaluated. In accordance with its extent, the image gloss difference is evaluated by the following four ranks.

| |
|---|
| A: Gloss difference is less than 3. |
| B: Gloss difference is 3 to less than 5. |
| C: Gloss difference is 5 to less than 9. |
| D: Gloss difference is 9 or more. |

The OHP transmittance is measured using Shimadzu Automatic Spectrophotometer UV2200 (manufactured by Shimadzu Corporation). Regarding the transmittance of only the OHP film as 100%, transmittance is measured at maximum absorption wavelength of;

in the case of magenta toner: 650 nm;

in the case of cyan toner: 500 nm; and in the case of yellow toner: 600 nm.

With regard to the anti-blocking properties of sample toners, the properties are evaluated after the samples have been left standing for a week in a 50° C. oven. To make evolution, the level of agglomeration is visually judged. Evalution criteria of toner agglomeration are shown below.

| | |
|---|---|
| A: | No agglomerate is seen at all, and fluidity is very good. |
| B: | No agglomerate is seen at all. |
| C: | Some agglomerates are seen, but become loose easily. |
| D: | Agglomerates become loose by means of a developer agitator (average) |
| E: | Agglomerates do not become loose well by means of a developer agitator (a little poor) |

The test results on fixing performance and OHP transmittance are shown in Table 3. The test results on the anti-blocking properties are shown in Table 2.

Examples 2 to 10

The cyan toners 2 to 10 and cyan developers 2 to 10 obtained in Toner Production Examples 2 to 10 were evaluated in the same manner as in Example 1. The results are shown in Tables 1 to 3.

Example 11

The cyan developer 1 obtained in Toner Production Example 1 and the magenta developer 1, yellow developer 1 and black developer 1 obtained in Toner Production Example 11 were put in the developing assemblies 111C, 111M, 111Y and 111K, respectively, shown in FIG. 3, and, using the heat fixing assembly 100 shown in FIG. 4, full-color images fixed at 150° C. were obtained.

The images obtained have a high gloss and also a wide color reproduction range, and hence are suitable especially when pictorial expression is needed. In addition, since the toner was fully fused at the time of fixing, the fixed toner was excellent in the OHP transmittance.

Comparative Example 1

The cyan toner 11 and cyan developer 11 obtained in Comparative Toner Production Example 1 were evaluated in the same manner as in Example 1. The results are shown in Tables 1 to 3.

Since the aromatic oxycarboxylic acid Al compound (I) was added in a large quantity, the cross-linking reaction at the time of kneading proceeded in excess, resulting in a high fixing-start temperature and a high high-temperature offset-start temperature, and also resulting in a low gloss and hence the color mixing region was restricted, resulting in a narrow color reproduction range.

At the same time, the toner fixed-image surface had so great unevenness that the incident light reflects irregularly, resulting also in a low OHP transmittance.

Comparative Example 2

The cyan toner 12 and cyan developer 12 obtained in Comparative Toner Production Example 2 were evaluated in the same manner as in Example 1. The results are shown in Tables 1 to 3.

Since any charge control agent is not used, any metal ion crosslinks are not formed at the time of kneading, and hence high-temperature offset occurs and the toner has low high-temperature anti-offset performance.

Comparative Examples 3 and 4

The cyan toners 13 and 14 and cyan developers 13 and 14 obtained in Comparative Toner Production Examples 3 and 4 were evaluated in the same manner as in Example 1. The results are shown in Tables 1 to 3.

In the cases where these charge control agents are used, any metal ion crosslinks are not formed at the time of kneading in both the cases of the cyan toners 13 and 14, and hence high-temperature offset occurs and the toner has low high-temperature anti-offset performance.

Comparative Examples 5 and 6

The cyan toners 15 and 16 and cyan developers 15 and 16 obtained in Comparative Toner Production Examples 5 and 6 were evaluated in the same manner as in Example 1. The results are shown in Tables 1 to 3.

In the case of the cyan toner 15, the low-temperature fixing performance is improved, but extremely poor high-temperature anti-offset and anti-blocking properties resulted.

In the case of the cyan toner 15, its fixing performance was not so badly influenced, but a low gloss results and hence the color mixing region was restricted, resulting in a narrow color reproduction range.

At the same time, the toner fixed-image surface had so great unevenness that the incident light reflected irregularly, resulting also in a low OHP transmittance.

Comparative Example 7

The cyan toner 17 and cyan developer 17 obtained in Comparative Toner Production Example 7 were evaluated in the same manner as in Example 1. The results are shown in Tables 1 to 3.

The polyethylene typifies waxes widely commonly added to improve anti-offset properties. However, the high-temperature offset occurred at a relatively low temperature, resulting in a narrow serviceable temperature range.

Comparative Example 8

The cyan toner 18 and cyan developer 18 obtained in Comparative Toner Production Example 8 were evaluated in the same manner as in Example 1. The results are shown in Tables 1 to 3.

Like the polyethylene, the polypropylene is also a wax widely commonly added to improve anti-offset properties. However, the high-temperature offset occurred in a much lower temperature range than the polyethylene, resulting in a narrower serviceable temperature range.

Comparative Example 9

The cyan toner 19 and cyan developer 19 obtained in Comparative Toner Production Example 9 were evaluated in the same manner as in Example 1. The results are shown in Tables 1 to 3.

Since the resin had a low Tg, it had low anti-blocking properties, and afforded a low molecular weight when made into the toner. Hence, although the toner had superior low-temperature fixing performance, but the toner was greatly inferior in the high-temperature anti-offset properties.

Comparative Example 10

The cyan toner 20 and cyan developer 20 obtained in Comparative Toner Production Example 10 were evaluated in the same manner as in Example 1. The results are shown in Tables 1 to 3.

Since the resin had a high Tg, it improved anti-blocking properties, but afforded a high molecular weight when made into the toner, resulting in a low gloss and hence the color mixing region was restricted, also resulting in a narrow color reproduction range.

At the same time, the toner fixed-image surface had so great unevenness that the incident light reflects irregularly, resulting also in a low OHP transmittance.

Comparative Example 11

The cyan toner 21 and cyan developer 21 obtained in Comparative Toner Production Example 11 were evaluated in the same manner as in Example 1. The results are shown in Tables 1 to 3.

In the case where the resin was the styrene-n-butyl acrylate copolymer, it improved anti-blocking properties, but afforded a high molecular weight when made into the toner, resulting in a low gloss and hence the color mixing region was restricted, also resulting in a narrow color reproduction range.

At the same time, the toner fixed-image surface had so great unevenness that the incident light reflected irregularly, resulting also in a low OHP transmittance.

Comparative Example 12

The cyan toner 16 and cyan developer 16 obtained in Comparative Toner Production Example 6 were evaluated in the same manner as in Example 1, except that the fixing assembly was constructed to have a rotary heating member having an elastic layer of 1,100 $\mu$m in thickness. The results are shown in Tables 1 to 3.

Since the elastic layer had a thickness of 1,000 $\mu$m or more, the elastic layer had so high thermal resistance as to make it difficult to achieve quick start.

TABLE 1

| | | Wax | | | | | |
|---|---|---|---|---|---|---|---|
| Toner No. | Binder resin Type | Type | Max. endo-thermic peak (° C.) | Peak half width (° C.) | Charge control agent Type | Amount (pbw) | Kneading temp. (° C.) |
| Toner Production Example: | | | | | | | |
| 1 Cyan toner 1 | PEs No. 1 | Paraffin (A) | 65 | 4 | Al comp. (I) | 6 | 120 |
| 2 Cyan toner 2 | PEs No. 1 | Paraffin (A) | 65 | 4 | Al comp. (I) | 2 | 120 |
| 3 Cyan toner 3 | PEs No. 1 | Paraffin (A) | 65 | 4 | Al comp. (I) | 9 | 120 |
| 4 Cyan toner 4 | PEs No. 1 | Ester | 72 | 5 | Al comp. (I) | 6 | 100 |
| 5 Cyan toner 5 | PEs No. 1 | Ester | 72 | 5 | Al comp. (I) | 6 | 180 |
| 6 Cyan toner 6 | PEs No. 1 | Ester | 72 | 5 | Cr comp. (II) | 6 | 180 |
| 7 Cyan toner 7 | PEs No. 1 | Paraffin (B) | 77 | 6 | Al comp. (I) | 6 | 120 |
| 8 Cyan toner 8 | PEs No. 1 | Paraffin (C) | 57 | 3 | Al comp. (I) | 6 | 120 |
| 9 Cyan toner 9 | PEs No. 2 | Paraffin (A) | 65 | 4 | Al comp. (I) | 6 | 120 |
| 10 Cyan toner 10 | PEs No. 3 | Paraffin (A) | 65 | 4 | Al comp. (I) | 6 | 120 |
| Comparative Toner Production Example: | | | | | | | |
| 1 Cyan toner 11 | PEs No. 1 | Paraffin (A) | 65 | 4 | Al comp. (I) | 12 | 120 |
| 2 Cyan toner 12 | PEs No. 1 | Paraffin (A) | 65 | 4 | — | 0 | 120 |
| 3 Cyan toner 13 | PEs No. 1 | Paraffin (A) | 65 | 4 | Zn comp. (III) | 6 | 120 |
| 4 Cyan toner 14 | PEs No. 1 | Paraffin (A) | 65 | 4 | Fe comp. (IV) | 6 | 120 |
| 5 Cyan toner 15 | PEs No. 1 | Paraffin (D) | 53 | 4 | — | 0 | 120 |
| 6 Cyan toner 16 | PEs No. 1 | Paraffin (E) | 85 | 5 | — | 0 | 120 |
| 7 Cyan toner 17 | PEs No. 1 | Polyethylene | 100 | 15 | — | 0 | 120 |
| 8 Cyan toner 18 | PEs No. 1 | Polypropylene | 145 | 19 | — | 0 | 120 |
| 9 Cyan toner 19 | PEs No. 4 | Paraffin (A) | 65 | 4 | — | 0 | 120 |
| 10 Cyan toner 20 | PEs No. 5 | Paraffin (A) | 65 | 4 | — | 0 | 120 |
| 11 Cyan toner 21 | Styrene acrylic | Paraffin (A) | 65 | 4 | — | 0 | 120 |

PEs: Polyester resin

TABLE 2

| Toner | Toner physical properties | | | | | | | | | | | |
|---|---|---|---|---|---|---|---|---|---|---|---|---|
| | Viscoelasticity | | | Soxhlet extraction | | | | | | | | |
| | | | G'140/ | Insoluble matter | | | | GPC | | | | (1) |
| No. | G'140 ($dN/m^2$) | G'170 ($dN/m^2$) | G'170 (wt. %) | A | B (° C.) | B/A | DSC Tg | Mn | Mw | Mw/Mn | (2) |
| Toner Production Example: | | | | | | | | | | | | |
| 1 CT 1 | 8,510 | 51,320 | 0.166 | 14.1 | 7.6 | 0.51 | 63 | 3,420 | 36,800 | 10.8 | A |
| 2 CT 2 | 7,770 | 160 | 48.6 | 16.2 | 4.8 | 0.30 | 62 | 3,390 | 33,800 | 10.0 | B |
| 3 CT 3 | 7,990 | 149,600 | 0.053 | 13.2 | 9.5 | 0.72 | 64 | 3,510 | 48,900 | 13.9 | A |
| 4 CT 4 | 8,380 | 3,500 | 2.394 | 12.9 | 1.9 | 0.15 | 61 | 3,420 | 34,800 | 10.2 | B |
| 5 CT 5 | 9,980 | 99,260 | 0.101 | 18.9 | 9.5 | 0.50 | 64 | 3,410 | 59,500 | 17.4 | A |
| 6 CT 6 | 8,250 | 89,670 | 0.092 | 18.2 | 8.8 | 0.48 | 64 | 3,610 | 49,500 | 13.7 | A |
| 7 CT 7 | 8,920 | 48,260 | 0.185 | 12.1 | 8.8 | 0.73 | 63 | 3,160 | 37,100 | 11.7 | A |
| 8 CT 8 | 79,600 | 53,690 | 1.5 | 13.4 | 9.2 | 0.69 | 62 | 3,260 | 38,600 | 11.8 | C |
| 9 CT 9 | 6,780 | 2,260 | 3.0 | 10.8 | 2.2 | 0.20 | 57 | 3,020 | 9,890 | 3.3 | B |
| 10 CT 10 | 89,220 | 70,650 | 1.3 | 17.6 | 8.8 | 0.50 | 69 | 6,420 | 30,100 | 4.7 | A |
| Comparative Toner Production Example: | | | | | | | | | | | |
| 1 CT 11 | 8,010 | 165,900 | 0.048 | 23.5 | 22.9 | 0.97 | 65 | 3,550 | 75,630 | 21.3 | D |
| 2 CT 12 | 480 | 20 | 24.0 | 1.3 | 1.1 | 0.85 | 60 | 3,340 | 33,690 | 10.1 | E |
| 3 CT 13 | 6,980 | 160 | 43.6 | 2.1 | 1.9 | 0.90 | 61 | 3,410 | 33,550 | 9.8 | E |
| 4 CT 14 | 7,060 | 210 | 33.6 | 1.9 | 1.7 | 0.89 | 60 | 3,390 | 33,620 | 9.9 | D |
| 5 CT 15 | 8,550 | 120 | 71.3 | 0.9 | 0.9 | 1.00 | 62 | 3,490 | 33,210 | 9.5 | E |
| 6 CT 16 | 9,010 | 190 | 47.4 | 1.5 | 1.3 | 0.87 | 63 | 3,520 | 34,580 | 9.8 | C |
| 7 CT 17 | 6,590 | 260 | 25.3 | 1.2 | 1.1 | 0.92 | 62 | 3,520 | 33,300 | 9.5 | C |
| 8 CT 18 | 5,590 | 320 | 17.5 | 1.4 | 1.2 | 0.86 | 63 | 3,480 | 33,510 | 9.6 | C |
| 9 CT 19 | 5,020 | 80 | 62.8 | 0.5 | 0.4 | 0.80 | 53 | 1,720 | 3,030 | 1.8 | E |
| 10 CT 20 | 106,820 | 890 | 120.0 | 4.2 | 3.8 | 0.90 | 73 | 10,520 | 223,650 | 21.3 | D |
| 11 CT 21 | 118,950 | 560 | 212.4 | 42.2 | 41.9 | 0.99 | 62 | 10,360 | 301,600 | 29.1 | D |

CT: Cyan toner (1)Anti-blocking properties (visually evaluated on how toner agglomerates after left standing at 50° C. for a week)

(2)Toner agglomeration

TABLE 3

| Toner (° C.) | Fixing performance and high-gloss temperature region | | | | | |
|---|---|---|---|---|---|---|
| | Solid image fixing start temp. (° C.) | High-temp. offset start temp. (deg.) | Service-able temp. region (%) | 160° C.-Fixed-image gloss (%) | OHP Image gloss difference (%) | transparency Transmittance |
| Example: | | | | | | |
| 1 Cyan toner 1 | 100 | 180 | 80 | 22 | A | 84 |
| 2 Cyan toner 2 | 100 | 165 | 65 | 26 | B | 82 |
| 3 Cyan toner 3 | 115 | >220 | >105 | 16 | A | 73 |
| 4 Cyan toner 4 | 100 | 165 | 65 | 26 | B | 80 |
| 5 Cyan toner 5 | 110 | >220 | >110 | 17 | A | 73 |
| 6 Cyan toner 6 | 100 | 175 | 85 | 21 | A | 82 |
| 7 Cyan toner 7 | 100 | 185 | 70 | 19 | A | 80 |
| 8 Cyan toner 8 | 100 | 170 | 75 | 22 | A | 83 |
| 9 Cyan toner 9 | 100 | 175 | 75 | 25 | B | 80 |
| 10 Cyan toner 10 | 110 | >220 | >110 | 17 | A | 75 |
| Comparative Example | | | | | | |
| 1 Cyan toner 11 | 130 | >220 | >90 | 3 | A | 46 |
| 2 Cyan toner 12 | 100 | 115 | 15 | Unmeasurable | Unmeasurable | Unmeasurable |
| 3 Cyan toner 13 | 110 | 140 | 30 | Unmeasurable | Unmeasurable | Unmeasurable |
| 4 Cyan toner 14 | 110 | 130 | 20 | Unmeasurable | Unmeasurable | Unmeasurable |
| 5 Cyan toner 15 | 100 | 140 | 40 | Unmeasurable | Unmeasurable | Unmeasurable |
| 6 Cyan toner 16 | 110 | 195 | 85 | 14 | B | 38 |
| 7 Cyan toner 17 | 110 | 140 | 30 | Unmeasurable | Unmeasurable | Unmeasurable |
| 8 Cyan toner 18 | 110 | 120 | 10 | Unmeasurable | Unmeasurable | Unmeasurable |
| 9 Cyan toner 19 | 100 | 130 | 30 | Unmeasurable | Unmeasurable | Unmeasurable |
| 10 Cyan toner 20 | 145 | >220 | >75 | 4 | A | 19 |

TABLE 3-continued

| Toner (° C.) | Fixing performance and high-gloss temperature region: Solid image fixing start temp. (° C.) | High-temp. offset start temp. (deg.) | Service-able temp. region (%) | 160° C.-Fixed-image gloss (%) | OHP Image gloss difference (%) | transparency Transmittance |
|---|---|---|---|---|---|---|
| 11 Cyan toner 21 | 155 | >220 | >65 | 2 | A | 6 |
| 12 Cyan toner 16 | 130 | 180 | 55 | 13 | C | 32 |

What is claimed is:

1. A toner comprising toner particles containing at least a binder resin, a colorant and a wax, and an external additive;

said wax having, in its differential scanning calorimetry endothermic curve, a maximum endothermic peak at 55° C. to 80° C. within a range of temperature of from 30° C. to 160° C.; said maximum endothermic peak having a half width of from 2° C. to 7° C.; and said binder resin being composed chiefly of a polyester resin;

said toner having:

a dynamic elastic modulus at a temperature of 140° C., $G'_{140}$, of from $5\times10^2$ dN/m$^2$ to $1\times10^5$ dN/m$^2$, and its ratio to a dynamic elastic modulus at a temperature of 170° C., $G'_{170}$, i.e., $G'_{140}/G'_{170}$ being from 0.05 to 50; and in Soxhlet extraction of the toner by using tetrahydrofuran as a solvent, tetrahydrofuran-insoluble matter A of a binder resin component after 8 hours from the start of extraction being from 10% by weight to 20% by weight and tetrahydrofuran-insoluble matter B of the binder resin component after 24 hours from the start of extraction being from 1% by weight to 10% by weight; the ratio of the tetrahydrofuran-insoluble matter A to the tetrahydrofuran-insoluble matter B, B/A, being from 0.1 to 0.8.

2. The toner according to claim 1, which toner has a glass transition temperature of from 55° C. to 72° C. and has, in gel permeation chromatography of its tetrahydrofuran-soluble matter, a number-average molecular weight Mn of from 1,500 to 10,000 and a weight-average molecular weight Mw of from 3,000 to 200,000; the ratio of Mw to Mn, Mw/Mn, being from 2 to 20.

3. The toner according to claim 1, which toner contains a salicylic acid metal compound in an amount of from 0.1% by weight to 10% by weight based on the weight of said toner.

4. A fixing method in which, using (1) a magnetic-field induction means, (2) a rotary heating member having at least a heating layer which generates heat by electromagnetic induction and a release layer and (3) a heating and pressing means having at least a rotary pressure member which forms a nip together with the rotary heating member, the rotary pressure member is pressed against the rotary heating member via a recording medium, during which a toner image held on the recording medium is fixed by heat and pressure to form a fixed image on the recording medium;

said toner image being formed by a toner comprising toner particles containing at least a binder resin, a colorant and a wax, and an external additive;

said wax having, in its differential scanning calorimetry endothermic curve, a maximum endothermic peak at 55° C. to 80° C. within the range of temperature of from 30° C. to 160° C.; said maximum endothermic peak having a half width of from 2° C. to 7° C.; and said binder resin being composed chiefly of a polyester resin;

said toner having:

a dynamic elastic modulus at a temperature of 140° C., $G'_{140}$, of from $5\times10^2$ dN/m$^2$ to $1\times10^5$ dN/m$^2$, and its ratio to a dynamic elastic modulus at a temperature of 170° C., $G'_{170}$, i.e., $G'_{140}/G'_{170}$ being from 0.05 to 50; and in Soxhlet extraction of the toner by using tetrahydrofuran as a solvent, tetrahydrofuran-insoluble matter A of a binder resin component after 8 hours from the start of extraction being from 10% by weight to 20% by weight and tetrahydrofuran-insoluble matter B of the binder resin component after 24 hours from the start of extraction being from 1% by weight to 10% by weight; a ratio of the tetrahydrofuran-insoluble matter A to the tetrahydrofuran-insoluble matter B, B/A, being from 0.1 to 0.8.

5. The fixing method according to claim 4, wherein said toner has a glass transition temperature of from 55° C. to 72° C. and has, in gel permeation chromatography of its tetrahydrofuran-soluble matter, a number-average molecular weight Mn of from 1,500 to 10,000 and a weight-average molecular weight Mw of from 3,000 to 200,000; the ratio of Mw to Mn, Mw/Mn, being from 2 to 20.

6. The fixing method according to claim 4, wherein said toner contains a salicylic acid metal compound in an amount of from 0.1% by weight to 10% by weight based on the weight of said toner.

7. The fixing method according to claim 4, wherein the heat generation layer of said rotary heating member has a thickness of from 1 $\mu$m to 200 $\mu$m, the release layer thereof has a thickness of from 1 $\mu$m to 100 $\mu$m, the nip formed between said rotary heating member and said rotary pressure member is in a width of from 5 mm to 15 mm, and said toner image is fixed by heat and pressure while said rotary pressure member is pressed against said rotary heating member via said recording medium at a surface pressure of from 9,000 N/m$^2$ to 500,000 N/m$^2$.

8. The fixing method according to claim 4, wherein said rotary heating member has an elastic layer.

* * * * *

UNITED STATES PATENT AND TRADEMARK OFFICE

CERTIFICATE OF CORRECTION

PATENT NO. : 6,929,894 B2
APPLICATION NO. : 10/191549
DATED : August 16, 2005
INVENTOR(S) : Nobuyoshi Sugahara et al.

It is certified that error appears in the above-identified patent and that said Letters Patent is hereby corrected as shown below:

ON THE TITLE PAGE ITEM [75]:

Inventors, "Masaaki Taya, Sbaraki (JP);" should read --Masaaki Taya, Shizuoka (JP);--.

COLUMN 6:

Line 31, "sal- " should read --sol- --.

COLUMN 23:

Line 40, "2,000," should read --2,000,000,--; and
Line 41, "000," should be deleted.

COLUMN 24:

Line 4, "MULTIISIZER" should read --MULTISIZER--.

COLUMN 29:

Line 38, "poor)" should read --poor).--.

UNITED STATES PATENT AND TRADEMARK OFFICE

CERTIFICATE OF CORRECTION

PATENT NO. : 6,929,894 B2
APPLICATION NO. : 10/191549
DATED : August 16, 2005
INVENTOR(S) : Nobuyoshi Sugahara et al.

It is certified that error appears in the above-identified patent and that said Letters Patent is hereby corrected as shown below:

COLUMN 33:

TABLE 2

"

| | Toner physical properties | | | | | | | | | | | | |
|---|---|---|---|---|---|---|---|---|---|---|---|---|---|
| | Viscoelasticity | | | | Soxhlet extraction | | | | | | | | |
| Toner | | | G'140/ | | Insoluble matter | | | | GPC | | | | (1) |
| No. (dM/m²) | G' 140 (dM/m²) | G'170 | G'170 (wt. %) | A | B (° C.) | B/A | DSC Tg | Mn | Mw | Mw/ Mn | (2) | | |

should read

TABLE 2

-- Toner physical properties --.

| | Viscoelasticity | | | | Soxhlet extraction | | | | | | | | GPC (1) |
|---|---|---|---|---|---|---|---|---|---|---|---|---|---|
| Toner | | | | | Insoluble matter | | DSC | | | | | | |
| No. (dM/m²) | G'140 (dM/m²) | G'170 | G'140/ G'170 (wt. %) | A | B (° C.) | B/A | DSC Tg | Mn | Mw | Mw/ Mn | (2) | | |

Signed and Sealed this

Fourteenth Day of August, 2007

JON W. DUDAS
*Director of the United States Patent and Trademark Office*